US010167588B2

(12) United States Patent
Kim et al.

(10) Patent No.: US 10,167,588 B2
(45) Date of Patent: Jan. 1, 2019

(54) WASHING MACHINE AND WASHING WATER SUPPLY DEVICE

(71) Applicant: SAMSUNG ELECTRONICS CO., LTD., Suwon (KR)

(72) Inventors: Min Hyung Kim, Seoul (KR); Hyun Mook Kim, Osan-si (KR); Yong Kwon Won, Suwon-si (KR); Masato Suzuki, Saitama (JP); Mitsuhiro Shigeri, Yokohama (JP); Young Sun Shin, Seoul (KR); Goan Su Jung, Yeosu-si (KR); Amitoj Singh, Gurgaon (IN); Gyu Woo Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 254 days.

(21) Appl. No.: 14/713,422

(22) Filed: May 15, 2015

(65) Prior Publication Data

US 2015/0247276 A1 Sep. 3, 2015

Related U.S. Application Data

(63) Continuation of application No. PCT/KR2014/012125, filed on Dec. 10, 2014.

(30) Foreign Application Priority Data

Jan. 29, 2014 (KR) ..... 10-2014-0011810
Feb. 25, 2014 (KR) ..... 10-2014-0021973
Dec. 10, 2014 (KR) ..... 10-2014-0176940

(51) Int. Cl.
*D06F 29/00* (2006.01)
*D06F 39/08* (2006.01)
(Continued)

(52) U.S. Cl.
CPC ..... *D06F 29/00* (2013.01); *D06F 31/00* (2013.01); *D06F 37/26* (2013.01); *D06F 39/005* (2013.01);
(Continued)

(58) Field of Classification Search
CPC . D06F 39/14; D06F 39/12; D06F 1/04; D06F 29/00; D06F 23/04
(Continued)

(56) References Cited

U.S. PATENT DOCUMENTS 94,501 A * 9/1869 Morahan ..... D06F 1/04 68/233
139,684 A * 6/1873 Morahan ..... D06F 1/04 68/233
(Continued)

FOREIGN PATENT DOCUMENTS

CN 101555656 A 10/2009
CN 202011992 U 10/2011
(Continued)

OTHER PUBLICATIONS

Philippians Office Action dated Jun. 8, 2015, in corresponding Philippine Patent Application No. 1/2015/501306.
(Continued)

*Primary Examiner* — David G Cormier
*Assistant Examiner* — Thomas Bucci
(74) *Attorney, Agent, or Firm* — Staas & Halsey LLP

(57) ABSTRACT

Provided is a washing machine including a main body having an opening and a door assembly disposed at the opening, wherein the door assembly includes a door that opens and closes the opening and an auxiliary washing unit having an auxiliary washing space in which hand-washing can be performed, and provided to pivot about one side of the door in an inside of the door. Through this configuration,
(Continued)

separated washing spaces can be provided and separate hand-washing can be performed. Also, pressure of washing water supplied into the washing machine can be regulated so that water supply efficiency can be improved and a flow rate of the washing water can be adjusted.

28 Claims, 29 Drawing Sheets

(51) Int. Cl.

| | |
|---|---|
| ***D06F 37/26*** | (2006.01) |
| ***D06F 31/00*** | (2006.01) |
| ***D06F 39/00*** | (2006.01) |
| ***D06F 39/12*** | (2006.01) |
| *D06F 39/02* | (2006.01) |
| *D06F 39/14* | (2006.01) |
| *D06F 1/04* | (2006.01) |
| *D06F 23/04* | (2006.01) |

(52) U.S. Cl.
CPC ..... *D06F 39/08* (2013.01); *D06F 39/12* (2013.01); *D06F 1/04* (2013.01); *D06F 23/04* (2013.01); *D06F 39/024* (2013.01); *D06F 39/083* (2013.01); *D06F 39/14* (2013.01)

(58) Field of Classification Search
USPC ..... 68/233, 3 R, 196, 13 R, 14, 17 R, 207, 68/23.3, 142, 38; 312/228, 328, 228.1, 312/139.2
See application file for complete search history.

(56) References Cited

U.S. PATENT DOCUMENTS

| | | | | | |
|---|---|---|---|---|---|
| 3,026,699 | A * | 3/1962 | Rhodes | D06F 29/00 | 68/12.19 |
| 3,039,284 | A * | 6/1962 | Shelton | D06F 29/00 | 137/360 |
| 3,039,286 | A * | 6/1962 | Shelton | D06F 29/00 | 137/312 |
| 3,209,560 | A * | 10/1965 | Shelton | D06F 13/00 | 68/14 |
| 3,490,254 | A * | 1/1970 | Mason | D06F 13/00 | 68/14 |
| 5,253,493 | A * | 10/1993 | Ohashi | D06F 39/14 | 220/812 |
| 7,296,443 | B2 * | 11/2007 | Usherovich | D06F 39/14 | 312/228.1 |
| 2002/0134117 | A1 | 9/2002 | Arai et al. | | |
| 2005/0072194 | A1 * | 4/2005 | Ryohke | D06F 19/00 | 68/3 R |
| 2006/0156763 | A1 * | 7/2006 | Vecchi | D06F 19/00 | 68/3 SS |
| 2011/0277515 | A1 | 11/2011 | Doh | | |

FOREIGN PATENT DOCUMENTS

| | | |
|---|---|---|
| CN | 202415963 U | 9/2012 |
| GB | 404785 | 11/1932 |
| JP | 7-20186 | 4/1995 |
| KR | 1999-016037 | 3/1999 |
| KR | 10-0220751 | 9/1999 |
| KR | 2003-0045447 | 6/2003 |
| KR | 10-2004-0008134 | 1/2004 |
| KR | 10-2005-0115965 | 12/2005 |
| KR | 10-0730921 | 6/2007 |
| KR | 20-2013-0001857 | 3/2013 |

OTHER PUBLICATIONS

Chinese Office Action May 31, 2017, in corresponding Chinese Patent Application No. 201480004769.9.
Canadian Notice of Allowance dated Jul. 10, 2017, in corresponding Canadian Patent Application No. 2,892,215.
International Search Report dated Mar. 27, 2015 in corresponding International Patent Application No. PCT/KR2014/012125.
Korean Office Action dated May 18, 2015 in corresponding Korean Patent Application No. 10-2015-0046513.
Korean Office Action dated May 12, 2015 in corresponding Korean Patent Application No. 10-2015-0046457.
U.S. Appl. No. 14/713,407, filed May 15, 2015, Min Hyung Kim, Samsung Electronics Co., Ltd.
U.S. Appl. No. 14/713,388, filed May 15, 2015, Min Hyung Kim, Samsung Electronics Co., Ltd.
First Action Interview Pilot Program Pre-Interview Communication dated Jun. 12, 2015 in corresponding U.S. Appl. No. 14/713,407.
First Action Interview Pilot Program Pre-Interview Communication dated Jun. 11, 2015 in corresponding U.S. Appl. No. 14/713,388.
Machine translation of unexamined publication KR 10-1999-0016037, Mar. 5, 1999.
Machine translation of unexamined publication KR 10-2003-0045447, Jun. 11, 2003.
Notice of Allowance dated Sep. 25, 2015 in related U.S. Appl. No. 14/713,388.
Notice of Allowance dated Oct. 23, 2015 in related U.S. Appl. No. 14/713,407.
Supplemental Notice of Allowance dated Oct. 30, 2015 in related U.S. Appl. No. 14/713,407.
Australian Office Action dated May 9, 2016 in related Australian Patent Application No. 2014351098.
Canadian Office Action dated May 25, 2016 in related Canadian Patent Application No. 2,892,215.
Chinese Office Action dated Jul. 5, 2016 in related Chinese Patent Application No. 201480004769.9.
European Search Report dated Jun. 2, 2016 in related European Patent Application No. 14859342.9.
European Office Action dated Jun. 16, 2016 in related European Patent Application No. 14859342.9.
European Office Action dated Jan. 24, 2017, in corresponding European Patent Application No. 14 859 342.9.
Chinese Office Action dated Jan. 23, 2017, in corresponding Chinese Patent Application No. 21480004769.9.
South Africa Notice of Acceptance of Complete Specification accepted Nov. 4, 2016 in corresponding South African Patent Application No. 2015/06336.
Canadian Office Action dated Dec. 5, 2016 in corresponding Canadian Patent Application No. 2,892,215.
Korean Office Action dated Oct. 12, 2016 in corresponding Korean Patent Application No. 10-2015-0108113.
Korean Notice of Allowance dated Dec. 19, 2016 in corresponding Korean Patent Application No. 10-2015-0108113.
Philippines Notice of Allowance dated Aug. 22, 2017, in corresponding Philippines Patent Application No. 1/2015/501306.
European Office Action dated Sep. 7, 2017, in corresponding European Patent Application No. 14 859 342.9.
Chinese Office Action dated Oct. 18, 2017, in corresponding Chinese Patent Application No. 201480004769.9.
Chinese Office Action dated Feb. 5, 2018, in corresponding Chinese Patent Application No. 201480004769.9.
Mexican Office Action dated Sep. 24, 2018, in corresponding Mexican Patent Application No. Mx/a/2015/008546.

* cited by examiner

WASHING MACHINE AND WASHING WATER SUPPLY DEVICE

CROSS-REFERENCE TO RELATED APPLICATIONS

This application is a continuation of International Application PCT/KR2014/012125 filed Dec. 10, 2014, and claims foreign priority to Korean application 10-2014-0011810 filed Jan. 29, 2014, Korean application 10-2014-0021973 filed Feb. 25, 2014, and Korean application 10-2014-0176940 filed Dec. 10, 2014, the disclosures of which are incorporated herein by reference in their entireties.

BACKGROUND

1. Field

Embodiments relate to a washing machine and a washing water supply device, and more particularly, to a washing machine that is capable of performing auxiliary washing and adjusting pressure of washing water.

2. Description of the Related Art

A washing machine is a machine that washes laundry using electric power, and generally includes a outer tub in which washing water is stored, a inner tub that is rotatably installed in the outer tub, and a pulsator that is rotatably disposed at the bottom of the inner tub.

In general, a washing machine has a washing space formed by the outer tub and the inner tub, but no separate space for washing dirt from socks, white clothes, undergarments or the like is formed.

Also, washing water is supplied to the washing machine for washing.

In this case, when pressure of the supplied washing water is larger than necessary pressure, the washing water is not discharged to a desired point but is scattered around a periphery of the desired point, which is problematic.

SUMMARY

An embodiment is directed to providing a washing machine having an auxiliary washing unit in which an auxiliary washing space is formed for hand washing.

An embodiment is also directed to providing a washing water supply device having an improved washing water supply mechanism in which pressure of washing water can be adjusted, and a washing machine having the same.

One aspect of an embodiment provides a washing machine including: a main body having an opening; a washing tub installed in the main body and forming a main washing space; and an auxiliary washing unit forming an auxiliary washing space in a periphery of the opening and provided pivotably with respect to the main body.

The washing machine may further include a door provided pivotably with respect to the main body to open and close the opening.

When the auxiliary washing unit is disposed at the opening, the auxiliary washing space may be exposed when the door is opened, and the auxiliary washing space may be covered when the door is closed.

The washing machine may include: a door handle part disposed at one side of the door; and an auxiliary handle part disposed at one side of the auxiliary washing unit.

The door handle part and the auxiliary handle part may be disposed in parallel in a lengthwise direction.

The washing machine may include: a door pivot axis that is a center of rotation of the door; and an auxiliary pivot axis that is a center of rotation of the auxiliary washing unit, wherein the door pivot axis and the auxiliary pivot axis are provided to coincide with each other.

The auxiliary washing unit may include: a unit body configured to form the auxiliary washing space; an auxiliary pivot axis that is a center of rotation of the auxiliary washing unit; and an auxiliary pivot part configured to protrude from the unit body and disposed to pivot about the auxiliary pivot axis.

The door may include an insertion part concavely formed so that the auxiliary pivot part can be inserted and pivot.

The washing machine may further include a water supply device configured to supply washing water into the main body, wherein the water supply device may include a switching unit that is disposed to selectively supply the washing water to one of the main washing space and the auxiliary washing space.

The washing machine may further include an auxiliary water supply port disposed at one side of the auxiliary washing space and supplying washing water into the auxiliary washing space.

The auxiliary washing unit may include: a unit body including a bottom part and a side part formed to be inclined toward the bottom part; and a plurality of frictional protrusions disposed on the unit body and formed to be more convex than the adjacent unit body to increase friction of laundry.

The auxiliary washing unit may include an auxiliary drain configured to drain washing water used to wash in the auxiliary washing space, and the auxiliary washing unit may operate between a first position in which the auxiliary washing unit is disposed in the opening to perform hand-washing, and a second position in which the auxiliary washing unit pivots from the first position and the washing water can be discharged into the main washing space through the auxiliary drain.

The auxiliary washing unit may include a seating flange formed in a flange shape along an edge of the auxiliary washing unit, and the seating flange may be seated on the main body in the opening and the auxiliary washing unit can be fixed to the main body.

The auxiliary washing unit may be formed of an ABS material.

The auxiliary washing unit may be disposed at an upper portion of the washing tub.

When the auxiliary washing unit is disposed in the opening and the door is closed, if the auxiliary handle part is lifted, the auxiliary washing unit and the door may pivot simultaneously with respect to the main body.

The auxiliary washing unit can be moved to a closed position in which the auxiliary washing unit is disposed in the opening, and to an opened position in which the auxiliary washing unit is disposed outside the main body, and the door may pivot with respect to the main body in both the closed position and the opened position.

A pivot axis of the auxiliary washing unit and a pivot axis of the door may be approximately perpendicular to each other.

The pivot axis of the auxiliary washing unit and the pivot axis of the door may be disposed in parallel to be spaced apart from each other.

A range of pivotal movement of the auxiliary washing unit may be wider than a range of pivotal movement of the door.

A pivot axis of the auxiliary washing unit may be further forward than a pivot axis of the door.

Two auxiliary pivot parts may be formed in the unit body, and an auxiliary drain through which stagnant water in the auxiliary washing space can be discharged into the main washing space, may be formed between two auxiliary pivot parts.

A main water supply port configured to supply water into the main washing space may be formed at one side of the opening so that the water discharged through the main water supply port can be supplied into the main washing space through a space between the opening and the auxiliary washing unit.

Another aspect of an embodiment provides a washing machine including: a main body; a washing part including a outer tub in which washing water is stored, and a inner tub which is disposed in the outer tub and into which laundry is put, the washing part being disposed in the main body; an auxiliary washing part provided to be spaced apart from the washing part to enable hand-washing; and a washing water supply device configured to supply the washing water to the auxiliary washing part, wherein the washing water supply device may include: a housing including an inlet port through which the washing water is introduced into the housing and an outlet port through which the washing water is discharged to the auxiliary washing part; and a water pressure regulation device configured to regulate pressure of the washing water in the housing, and the water pressure regulation device may include a water pressure regulation chamber in which the washing water introduced through the inlet port is stored, which is disposed in the housing to be spaced apart from the outlet port and which has a larger width than a flow path inside the inlet port.

The water pressure regulation device may include: a discharge chamber provided in the housing to be spaced apart from the inlet port and formed to communicate with the outlet port; and an adjustment rib disposed in the housing to block at least a portion of the washing water that is moved from the water pressure regulation chamber to the discharge chamber.

The water pressure regulation device may further include a water pressure regulation hole that is formed on the same plane as the adjustment rib and provided so that the washing water is movable from the water pressure regulation chamber to the discharge chamber.

The water pressure regulation hole may be formed to have a smaller width than an inside of the housing so that the washing water can be throttled.

The adjustment rib may be provided in the housing to be perpendicular to a direction in which the washing water progresses.

The water pressure regulation device may further include an extension pipe formed to be bent and to extend from the inlet port and through which the washing water introduced from the inlet port is discharged into the water pressure regulation chamber.

The extension pipe may be formed to be bent upward and to extend from the inlet port so that the washing water can be discharged upward from an inside of the water pressure regulation chamber.

The water pressure regulation hole may be formed in a lower portion of the water pressure regulation chamber so that the washing water discharged from the extension pipe can be discharged while bypassing an inside of the water pressure regulation chamber.

The water pressure regulation device may further include a reinforcement rib formed along at least a portion of an edge of the adjustment rib and provided to prevent the adjustment rib from being deformed by pressure of the washing water.

The water pressure regulation hole may be formed so that the washing water passes through the water pressure regulation hole in the same direction in which the washing water passes through an inside of the inlet port.

The washing machine may include a water supply valve configured to supply the washing water to an inside from an outside of the main body, wherein the water supply valve may be provided to independently perform water supply control of the washing water supplied to the washing part and water supply control of the washing water supplied to the auxiliary washing part.

The washing water supply device may be disposed at a side portion of the auxiliary washing part, and the outlet port may be provided to be perpendicular to the inlet port with respect to the housing.

The washing water supply device may supply the washing water to the auxiliary washing part in at least one direction of front, sides, and rear of the auxiliary washing part.

The water pressure regulation device may further include an opening and closing member movably provided between a first position in which the outlet port is closed and a second position which is moved from the first position and in which the outlet port is opened.

The water pressure regulation device may include a discharge guide provided at an inside of the outlet port to guide the washing water discharged through the outlet port.

The discharge guide may be provided to have a mesh shape in the outlet port.

The discharge guide may be provided to have a shape of a plurality of ribs that are provided in parallel with each other in the outlet port.

Still another aspect of an embodiment provides a washing water supply device that supplies washing water to a washing machine, including: a housing including an inlet port and an outlet port through which the washing water is introduced or discharged; and a water pressure regulation part provided so that the washing water that passes through an inside of the housing is throttled, wherein the water pressure regulation part may include: an adjustment rib configured to block movement of the washing water in the housing; and a water pressure regulation hole formed on the same plane as the adjustment rib and formed by the adjustment rib and an inner surface of the housing.

The washing water supply device may further include: a water pressure regulation chamber configured to communicate with the inlet port; and a discharge chamber configured to communicate with the outlet port, wherein the water pressure regulation chamber and the discharge chamber may be partitioned by the adjustment rib.

The washing water supply device may further include an extension pipe which is formed to be bent and to extend from the inlet port and through which the washing water introduced from the inlet port is discharged into the water pressure regulation chamber.

A discharge port of the extension pipe may be provided to face an upper portion of the water pressure regulation chamber, and the water pressure regulation hole may be provided in a lower portion of the water pressure regulation chamber.

Still another aspect of an embodiment provides a washing machine including: a main body; a washing part including a outer tub in which washing water is stored and a inner tub rotatably provided in the outer tub, the washing part being disposed in the main body; an auxiliary washing part provided at an upper portion of the washing part to enable hand-washing; and a washing water supply device configured to supply the washing water to the auxiliary washing part, wherein the washing water supply device may include: a housing including an inlet port through which the washing water is received and an outlet port through which the washing water is discharged into the auxiliary washing part; a water pressure regulation chamber configured to communicate with the inlet port and disposed in the housing; a discharge chamber configured to communicate with the outlet port and disposed in the housing; and an adjustment rib configured to partition the water pressure regulation chamber and the discharge chamber and provided to interrupt progression of the washing water moving from the water pressure regulation chamber to the discharge chamber, the adjustment rib forming a water pressure regulation hole with an inner surface of the housing so that the washing water is capable of being moved from the water pressure regulation chamber to the discharge chamber.

The washing machine may further include an extension pipe formed to extend from the inlet port and through which the washing water is discharged upward from an inside of the water pressure regulation chamber.

The water pressure regulation hole may be disposed in a lower portion of the water pressure regulation chamber so that the washing water discharged from the extension pipe can be bypassed inside the water pressure regulation chamber and can move to the discharge chamber.

A washing machine and a washing water supply device according to an embodiment have an auxiliary washing unit, and thus enable hand washing laundry.

Also, hand washing can be performed independently from, and proceeding, an automatic washing, to improve washing efficiency.

Also, the auxiliary washing unit may be pivotably disposed so that an operation of the auxiliary washing unit for hand washing can be conveniently performed.

Also, a supply mechanism of the washing water may be improved so that pressure of the washing water can be adjusted.

Also, through the improved supply mechanism, a flow rate of the washing water discharged into the washing machine can be adjusted.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Hereinafter, exemplary embodiments will be described in detail with reference to the attached drawings.

Figure 1:
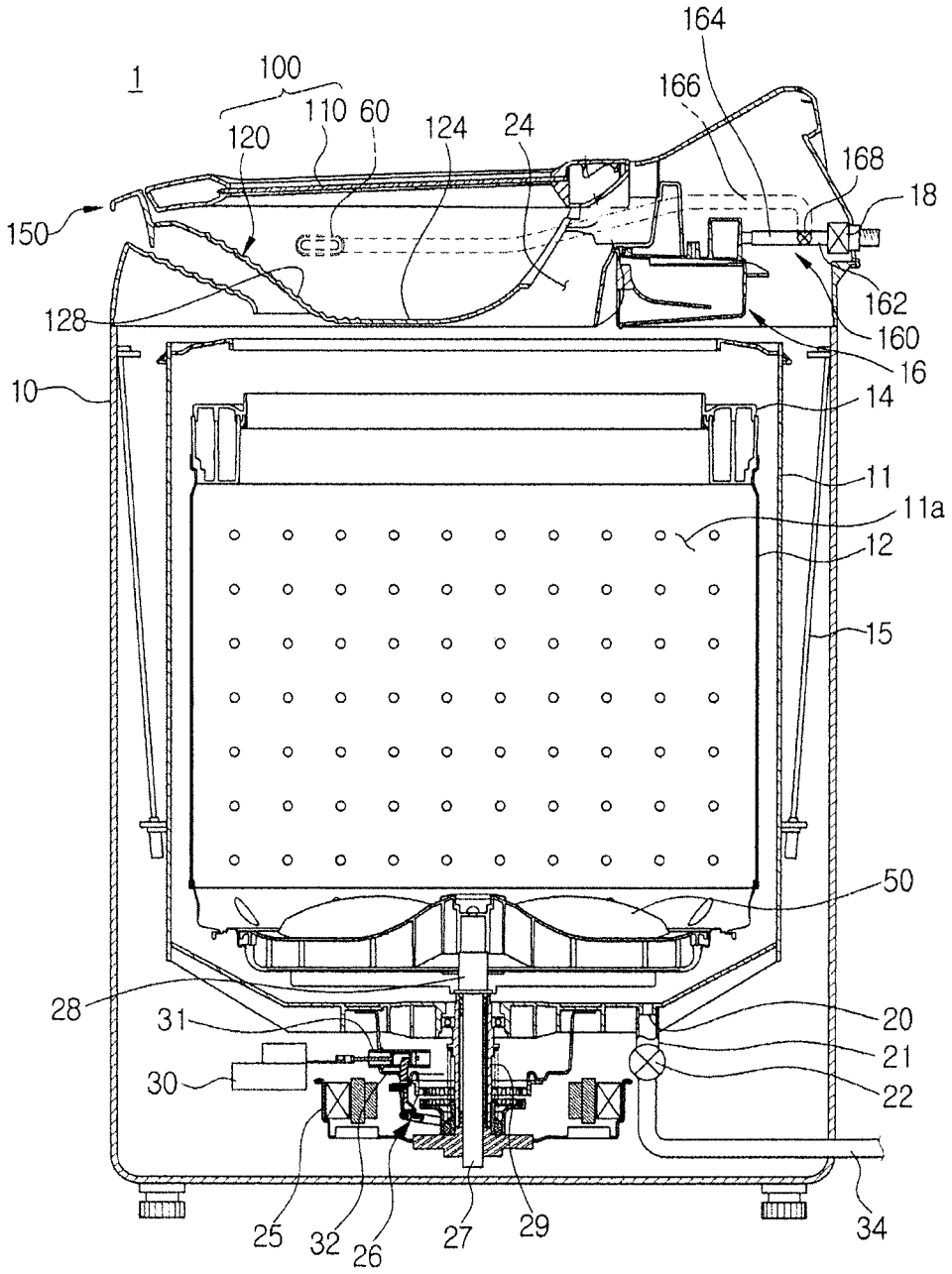
FIG. 1 is a cross-sectional view of a washing machine according to a first embodiment.

FIG. 1 is a cross-sectional view of a washing machine according to a first embodiment.

As illustrated in FIG. 1, a washing machine 1 includes a main body 10 that forms an exterior, an outer tub 11 that is disposed in the main body 10 and in which washing water is stored, an inner tub 12 that is rotatably disposed in the outer tub 11, and a pulsator 50 that is disposed in the inner tub 12 and generates a water current.

An opening 24 through which laundry may be put into the inner tub 12 may be formed in an upper portion of the main body 10. The opening 24 may be opened and closed by a door assembly 100 installed at the upper portion of the main body 10. The outer tub 11 may be supported on the main body 10 by a suspension device 15.

A water supply pipe 17 for supplying washing water into the outer tub 11 may be installed in an upper portion of the outer tub 11. One side of the water supply pipe 17 may be connected to an external water supply source, and the other side of the water supply pipe 17 may be connected to a detergent supply device 16. Water supplied through the water supply pipe 17 may be supplied into the outer tub 11 through the detergent supply device 16 together with detergent. A water supply valve 18 may be installed at the water supply pipe 17 to control water supply.

The inner tub 12 has a cylindrical shape with an opened upper portion, and a plurality of spin-drying holes 13 may be formed in sides of the inner tub 12. A balancer 14 may be mounted on the upper portion of the inner tub 12 so that the inner tub 12 can rotate stably during high-speed rotation.

A motor 25 that generates a driving force to rotate the inner tub 12 and the pulsator 50, and a power switching device 26 that simultaneously or selectively transfers the driving force generated by the motor 25 to the inner tub 12 and the pulsator 50 may be installed at a lower exterior of the outer tub 11.

A hollow spin-drying shaft 29 may be coupled to the inner tub 12, and a washing shaft 27 installed in a hollow portion of the spin-drying shaft 29 may be coupled to the pulsator 50 using a washing shaft coupling part 28. The motor 25 may simultaneously or selectively transfer the driving force to the inner tub 12 and the pulsator 50 according to an ascending/descending operation of the power switching device 26.

The power switching device 26 may include an actuator 30 that generates a driving force for power switching, a rod part 31 that performs a linear motion according to an operation of the actuator 30, and a clutch part 32 that is connected to the rod part 31 to pivot according to an operation of the rod part 31.

A drain 20 may be formed in a bottom of the outer tub 11 to discharge washing water stored in the outer tub 11, and a first drain pipe 21 may be connected to the drain 20. A drain valve 22 may be installed in the first drain pipe 21 to control drainage. An outlet of the drain valve 22 may be connected to a second drain pipe 34 for discharging washing water to the outside.

Figure 2:
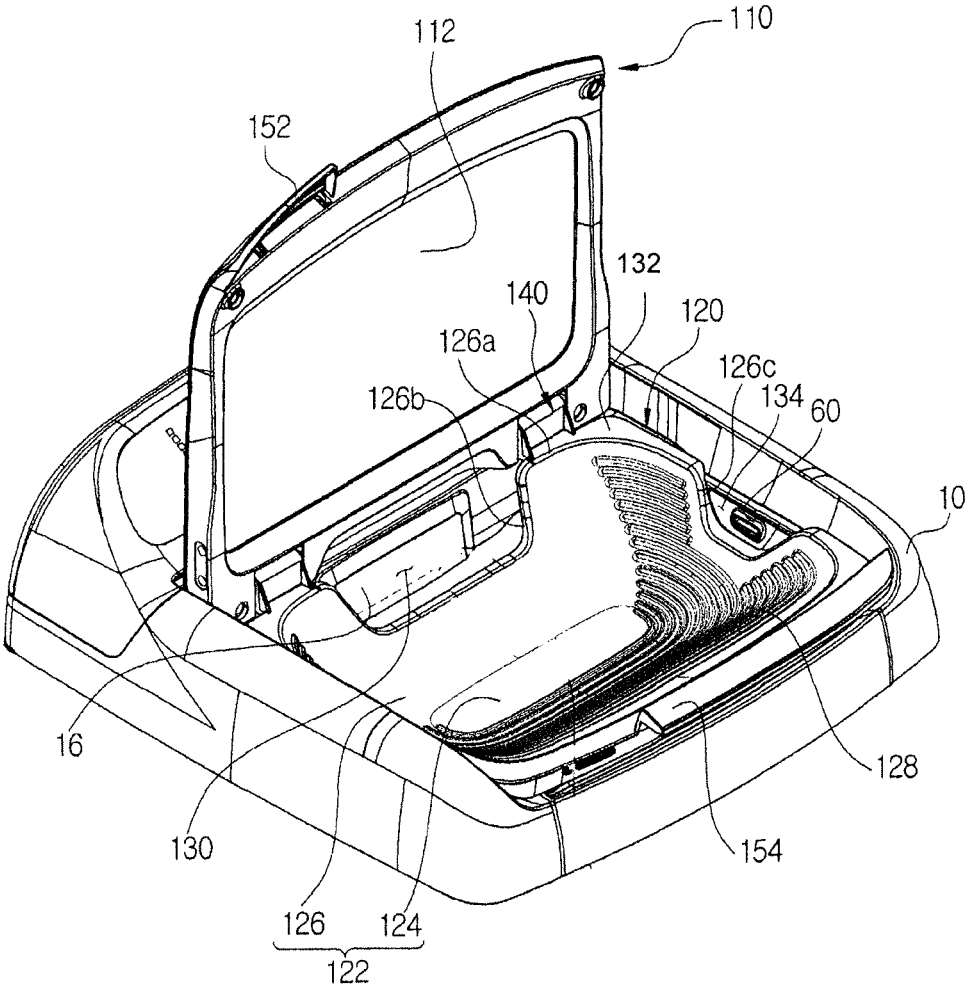
FIG. 2 is a perspective view of a state in which a door of the washing machine according to the first embodiment is opened.
Figure 3:
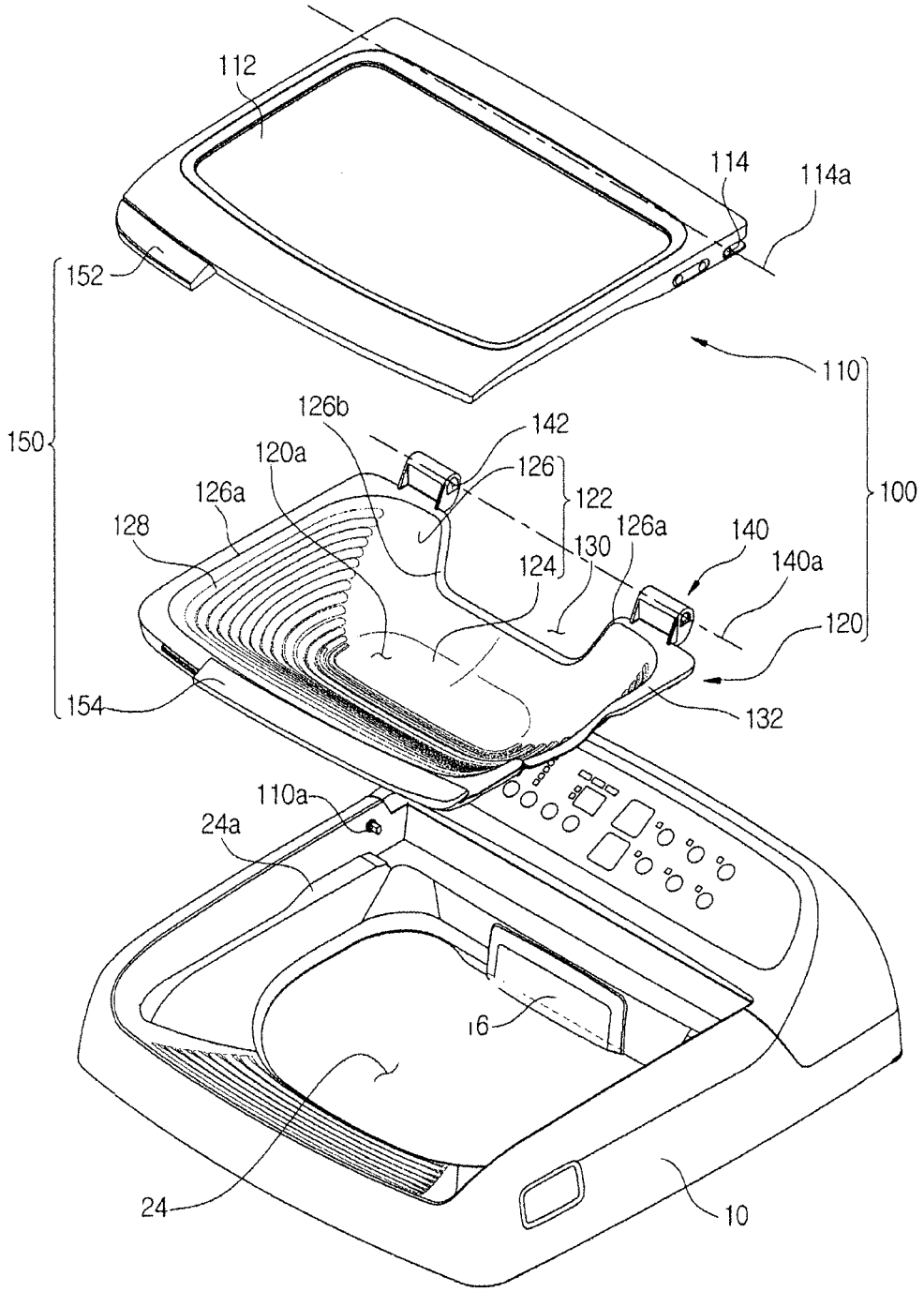
FIG. 3 is an exploded perspective view of a door assembly of the washing machine according to the first embodiment.
Figure 4:
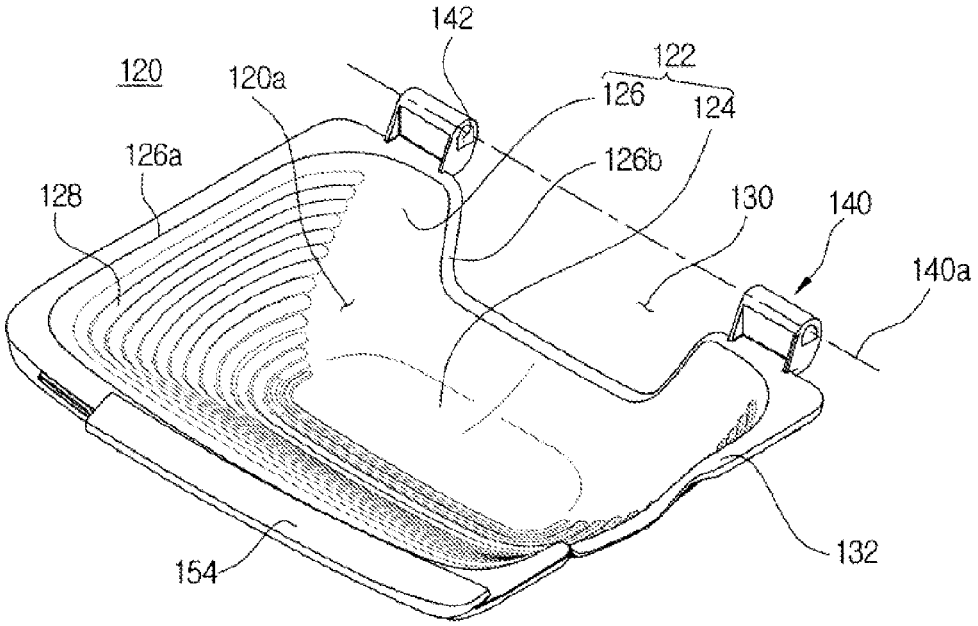
FIG. 4 is a perspective view of an auxiliary washing unit of the washing machine according to the first embodiment.

FIG. 2 is a perspective view of a state in which a door of the washing machine according to the first embodiment is opened, FIG. 3 is an exploded perspective view of a door assembly of the washing machine according to the first embodiment, and FIG. 4 is a perspective view of an auxiliary washing unit of the washing machine according to the first embodiment.

The door assembly 100 may be disposed at the opening 24.

The door assembly 100 may include a door 110 and an auxiliary washing unit 120.

The door 110 may be disposed at one side of the main body 10 to open and close the opening 24. A transparent member 112 may be disposed on the door 110 so that the inside of the washing machine 1 is visible even when the door 110 closes the opening 24.

The auxiliary washing unit 120 has an auxiliary washing space 120*a* in which hand-washing can be performed separately. The auxiliary washing space 120*a* may be provided so that hand washing can be performed separately from a main washing space 11*a* formed by the outer tub 11 and the inner tub 12. The outer tub 11 and the inner tub 12 that form the main washing space 11*a* may be defined as a washing tub.

The main washing space 11*a* and the auxiliary washing space 120*a* are separated from each other so that washing can be performed independently in each space. Also, washing in the main washing space 11*a* and the auxiliary washing space 120*a* may be performed separately or simultaneously.

The auxiliary washing unit 120 may be disposed under the door 110 to be pivotable about one side thereof. The auxiliary washing unit 120 may be disposed coaxially with a pivot axis of the door 110. Pivotal movement of the auxiliary washing unit 120 and the door 110 will be described later in detail.

The auxiliary washing unit 120 may include a unit body 122 including a bottom part 124 and a side part 126.

The auxiliary washing space 120*a* of the auxiliary washing unit 120 may be formed by the unit body 122. The bottom part 124, which is a factor determining a depth of the auxiliary washing space 120*a*, may be provided to be flat or curved. The side part 126 may be formed to be inclined toward the bottom part 124.

The bottom part 124 and the side part 126 may form the recessed auxiliary washing space 120*a* such that hand washing can be performed while washing water is reserved in the auxiliary washing space 120*a*.

The auxiliary washing unit 120 may include rubbing protrusions 128.

The rubbing protrusions 128 may be provided on the unit body 122 to facilitate auxiliary washing. In the present embodiment, the rubbing protrusions 128 are provided on the side part 126. However, the embodiments is not limited thereto. Any rubbing protrusions 128 that are provided on an inner surface of the unit body 122 may be used. The rubbing protrusions 128 serve to increase frictional force with the laundry when hand-washing is performed such that dirt is easily washed from the laundry. In the present embodiment, the rubbing protrusions 128 may be raised on inner surface of the auxiliary washing unit 120. The plurality of rubbing protrusions 128 may be formed in parallel. However, the shape and arrangement of the rubbing protrusions 128 are not limited.

The auxiliary washing unit 120 may include an auxiliary drain 130.

The auxiliary drain 130 may be provided to drain the washing water reserved in the auxiliary washing space 120*a*. The auxiliary drain 130 may be provided in a hole shape, may have an opening and closing member, and may be disposed in the bottom part 124 of the auxiliary washing space 120*a*. In the present embodiment of, the auxiliary drain 130 may be formed in the side part 126 of the unit body 122. The auxiliary drain 130 may be provided so that the washing water stored in the auxiliary washing space 120*a* may be discharged during the auxiliary washing unit 120 is pivoting.

The auxiliary drain 130 may be formed by an edge 126*b* of the auxiliary drain 130 formed to be lower than an adjacent upper end 126*a* of the unit body 122. That is, the auxiliary drain 130 may be formed in a shape that a portion of the side part is recessed from the upper end 126*a* of the unit body 122. However, the shape of the auxiliary drain 130 is not limited as long as the washing water stored in the auxiliary washing space 120*a* can be discharged when the auxiliary washing unit 120 is tilted.

The auxiliary washing unit 120 may include a seating flange 132.

The seating flange 132 may be formed in a flange shape on an upper end of the auxiliary washing unit 120 along an edge thereof and is disposed to be seated on the main body 10. That is, the seating flange 132 may be provided in the flange shape along the upper end of the unit body 122.

A seating part 24*a* that protrudes toward the opening 24 may be provided around the opening 24 of the main body 10. The seating flange 132 may be supported on the seating part 24*a*. The seating flange 132 sits on the seating part 24*a* so that the auxiliary washing unit 120 can be firmly mounted to the main body 10.

A water supply device 160 for supplying water into the main washing space 11*a* and the auxiliary washing space 120*a* may be provided.

The water supply device 160 may include a water supply pipe 162, a main water supply pipe 164, an auxiliary water supply pipe 166, and a switching unit 168.

One end of the water supply pipe 162 may be connected to the water supply valve 18, and the other end thereof may be connected to the switching unit 168. The water supply pipe 162 may be provided to transfer the washing water supplied from the water supply valve 18 to the switching unit 168.

The main water supply pipe 164 may be provided to supply water into the main washing space 11*a*. One end of the main water supply pipe 164 may be connected to the detergent supply device 16, and the other end thereof may be connected to the switching unit 168. A water supply port (not shown) may be disposed in the detergent supply device 16 so that water introduced through the main water supply pipe 164 can be discharged to the water supply port via the detergent supply device 16. Water that passes through the water supply port may be supplied into the main washing space 11*a* through a space between the opening 24 and the auxiliary washing unit 120.

The auxiliary water supply pipe 166 may be provided to supply water into the auxiliary washing space 120*a* of the auxiliary washing unit 120. One end of the auxiliary water supply pipe 166 may be connected to an auxiliary water supply port 60, and the other end thereof may be connected to the switching unit 168.

The switching unit 168 may be provided to selectively supply the washing water transferred from the water supply pipe 162 to one of the main water supply pipe 164 and the auxiliary water supply pipe 166. That is, the switching unit 168 may be provided so that the washing water can be supplied into a washing space through at least one of the main water supply pipe 164 and the auxiliary water supply pipe 166 through control of the switching unit 168. The switching unit 168 may include a three-way valve.

In an embodiment, the main water supply pipe 164 and the auxiliary water supply pipe 166 may be provided to branch off from the water supply pipe 162 with the switching unit 168 interposed therebetween. Alternatively, the main water supply pipe 164 and the auxiliary water supply pipe 166 may be connected to the water supply valve 18 so that the washing water can be supplied by controlling the water supply valve 18. That is, the other end of the main water supply pipe 164 having the one end connected to the detergent supply device 16, and the other end of the auxiliary water supply pipe 166 having the one end connected to the auxiliary water supply port 60 may be connected to the water supply valve 18.

Also, in an embodiment, the washing water may be selectively supplied to one of the main water supply pipe 164 and the auxiliary water supply pipe 166. However, the washing water may be simultaneously supplied to the main water supply pipe 164 and the auxiliary water supply pipe 166.

The auxiliary water supply port 60 may be disposed in communication with the auxiliary water supply pipe 166. The auxiliary water supply port 60 may be disposed at one side of the auxiliary washing unit 120 to supply the washing water into the auxiliary washing unit 120.

The auxiliary washing unit 120 may include a washing water inlet 134 corresponding to the auxiliary water supply port 60, so that the washing water supplied from the auxiliary water supply port 60 can be introduced into the auxiliary washing unit 120. The washing water inlet 134 may be formed by an inlet edge 126*c* formed to be lower than the adjacent upper end 126*a* of the unit body 122. That is, the washing water inlet 134 may be formed in a shape that a portion of the side part is recessed from the upper end of the unit body 122. However, the shape of the washing water inlet 134 is not limited as long as the washing water can be introduced into the auxiliary washing space 120*a* without interference with by the unit body 122 when the washing water is introduced through the auxiliary water supply port 60.

The auxiliary washing unit 120 may be formed of a thermoplastic resin. The auxiliary washing unit 120 may be formed of an ABS material. However, embodiments are not limited thereto, and the auxiliary washing unit 120 may be formed of any material having sufficient shock resistance and rigidity for hand-washing.

Figure 5:
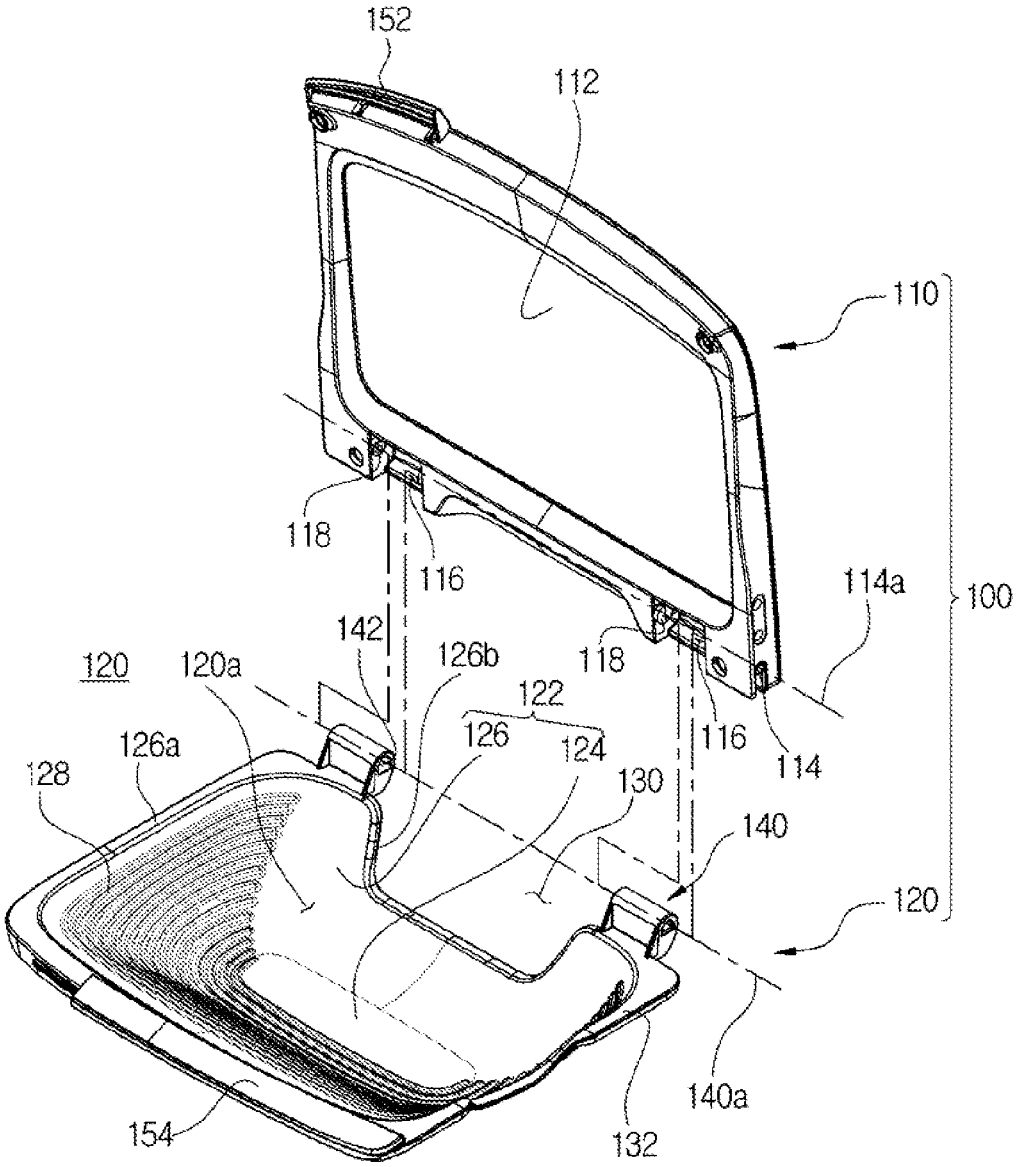
FIG. 5 is a perspective view of coupling of the door assembly of the washing machine according to the first embodiment.
Figure 6:
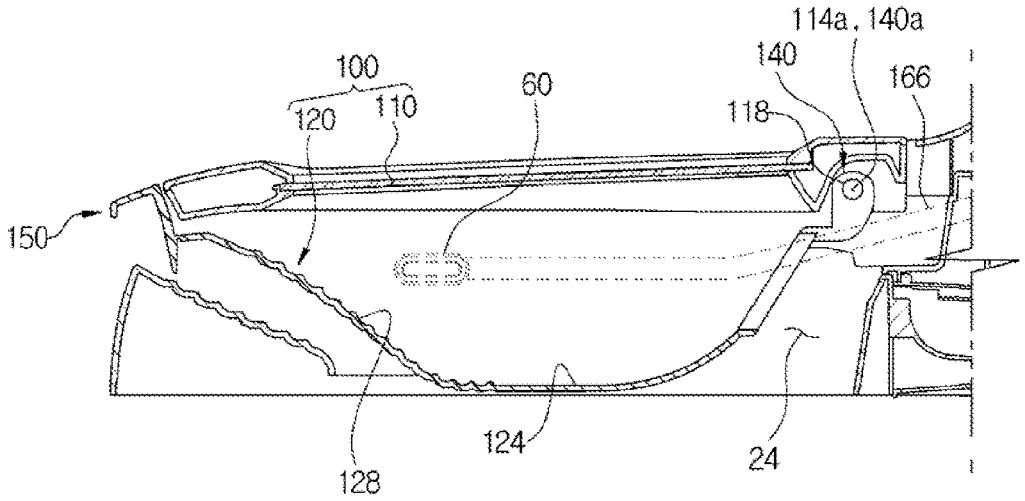
FIG. 6 is a cross-sectional view of a door assembly of the washing machine according to the first embodiment.
Figure 7:
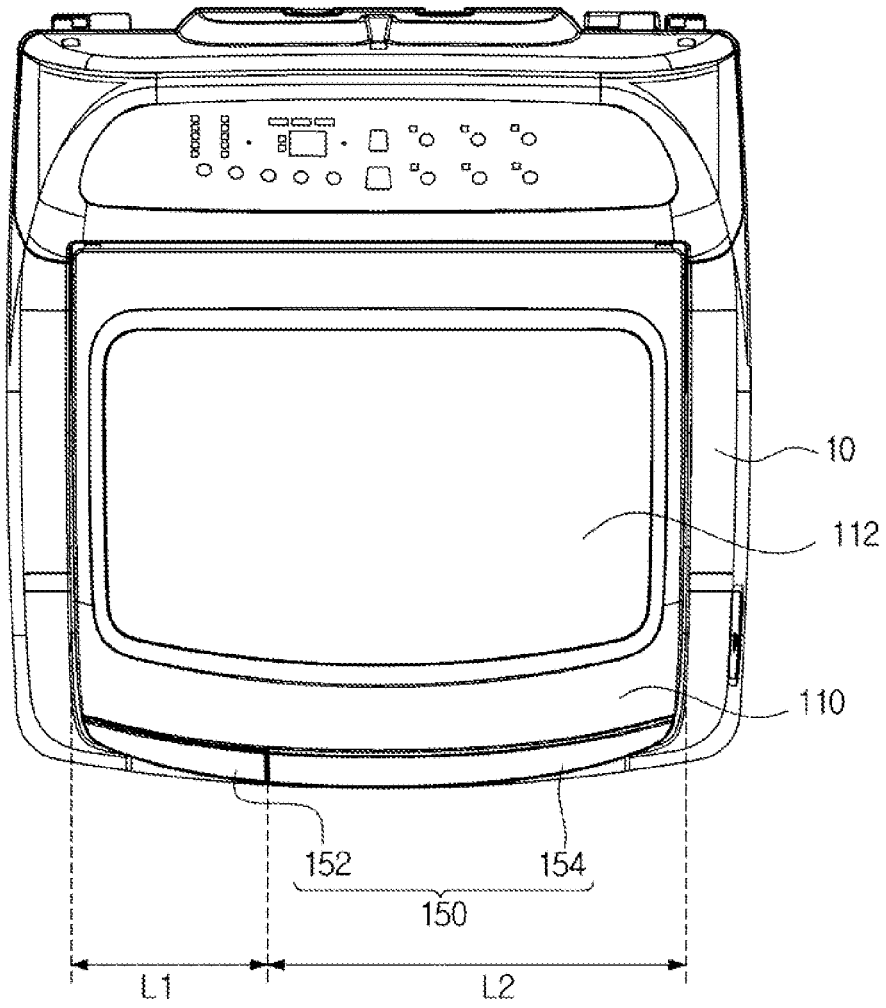
FIG. 7 is a top view of the washing machine according to the first embodiment.

FIG. 5 is a perspective view of coupling of auxiliary door assembly of the washing machine according to the first embodiment, FIG. 6 is a cross-sectional view of a door assembly of the washing machine according to the first embodiment, and FIG. 7 is a top view of the washing machine according to the first embodiment.

The door 110 and the auxiliary washing unit 120 may each be provided to be pivotable with respect to the main body 10.

The door 110 may be provided to be pivotable about a main water supply pipeinlet axis 114*a*, and the auxiliary washing unit 120 may be provided to be pivotable about an auxiliary pivot axis 140*a*.

In an embodiment, the door pivot axis 114*a* and the auxiliary pivot axis 140*a* may be disposed on the same side of the door 110 and the auxiliary washing unit 120 to be opened and closed in the same direction.

The door pivot axis 114*a* and the auxiliary pivot axis 140*a* may be coaxial. That is, the door pivot axis 114*a* and the auxiliary pivot axis 140*a* may be coincident.

To this end, the door 110 may be pivotably coupled to the main body 10 by a door pivot part 110*a* disposed on the main body 10 along the door pivot axis 114*a*, and the auxiliary washing unit 120 may be pivotably coupled to the door 110 by an auxiliary pivot part 140.

The door pivot part 110*a* may be formed in a shape that protrudes toward the door pivot axis 114*a* so that the door 110 can pivot about the door pivot axis 114*a* on the main body 10. Specifically, an accommodation part 114 may be disposed in the door 110, and the door pivot part 110*a* may be inserted into the accommodation part 114 so that the door 110 is pivotably supported by the main body 10. However, embodiments are not limited thereto, and the door pivot part 110*a* may be formed in a shape that protrudes toward the door pivot axis 114*a* so that the door 110 can pivot about the door pivot axis 114*a* on an outer surface of the door 110. The shape of the door pivot part 110*a* is not limited, and any shape with which the door 110 is pivotable with respect to the main body 10 may be used.

The door 110 may include an insertion part 116 formed to be recessed from one side of the door 110 so that the auxiliary pivot part 140 can pivot, and pivot protrusions 118 may be formed on the insertion part 116 to protrude toward the auxiliary pivot axis 140*a* so that the auxiliary washing unit 120 can pivot about the auxiliary pivot axis 140*a*. Pivot holes 142 corresponding to the pivot protrusions 118 may be formed in the auxiliary washing unit 120. The auxiliary pivot part 140 may be pivotably inserted into a part of the door 110 so that the door pivot axis 114*a* and the auxiliary pivot axis 140*a* coincide.

However, the shape and arrangement in which the door 110 and the auxiliary washing unit 120 pivot are not limited. Any shape or arrangement in which the door 110 and the auxiliary washing unit 120 are configured to open and close the opening 24 may be used.

The auxiliary pivot part 140 may be provided to protrude from the unit body 122 so that the auxiliary pivot axis 140*a* is spaced apart from the unit body 122. Through this configuration, a rotational radius of the auxiliary washing unit 120 may be increased, and the unit body 122 may also be prevented from interfering with the door 110 or the main body 10 when the auxiliary washing unit 120 pivots.

The door assembly 100 may include a handle part 150.

The handle part 150 may include a door handle part 152 provided at the door 110, and an auxiliary handle part 154 provided at the auxiliary washing unit 120.

The door handle part 152 may be disposed at the other side of the door 110 to correspond to the door pivot axis 114*a* disposed at one side thereof. In the same manner, the auxiliary handle part 154 may be disposed at the other side of the auxiliary washing unit 120 to correspond to the auxiliary pivot axis 140*a* disposed at one side thereof. The door handle part 152 and the auxiliary handle part 154 may be provided in parallel in a lengthwise direction.

The door handle part 152 and the auxiliary handle part 154 may be provided on a front surface of the door 110 and a front surface of the auxiliary washing unit 120, respectively, so that the door 110 and the auxiliary washing unit 120 can be pivoted. The door 110 may be pivoted through an operation of the door handle part 152, and only the auxiliary washing unit 120 may be pivoted or the auxiliary washing unit 120 and the door 110 may be pivoted together through an operation of the auxiliary handle part 154.

On a front surface of the door assembly 100, the door handle part 152 may be formed to have a first length L1, and the auxiliary handle part 154 may be formed to have a second length L2 in parallel with the first length L1. When the door handle part 152 is operated, the door 110 may pivot, and when the auxiliary handle part 154 is operated while the door 110 is opened, the auxiliary washing unit 120 may be pivoted. When the auxiliary handle part 154 is operated while the door 110 is closed, the door 110 and the auxiliary washing unit 120 may be pivoted together, and thus the second length L2 may be longer than the first length L1 in consideration of weights of the door 110 and the auxiliary washing unit 120. That is, the auxiliary handle part 154 may be formed longer than the door handle part 152.

Hereinafter, an operation of the door assembly 100 of the washing machine 1 having the above configuration will be described.

Figure 8A:
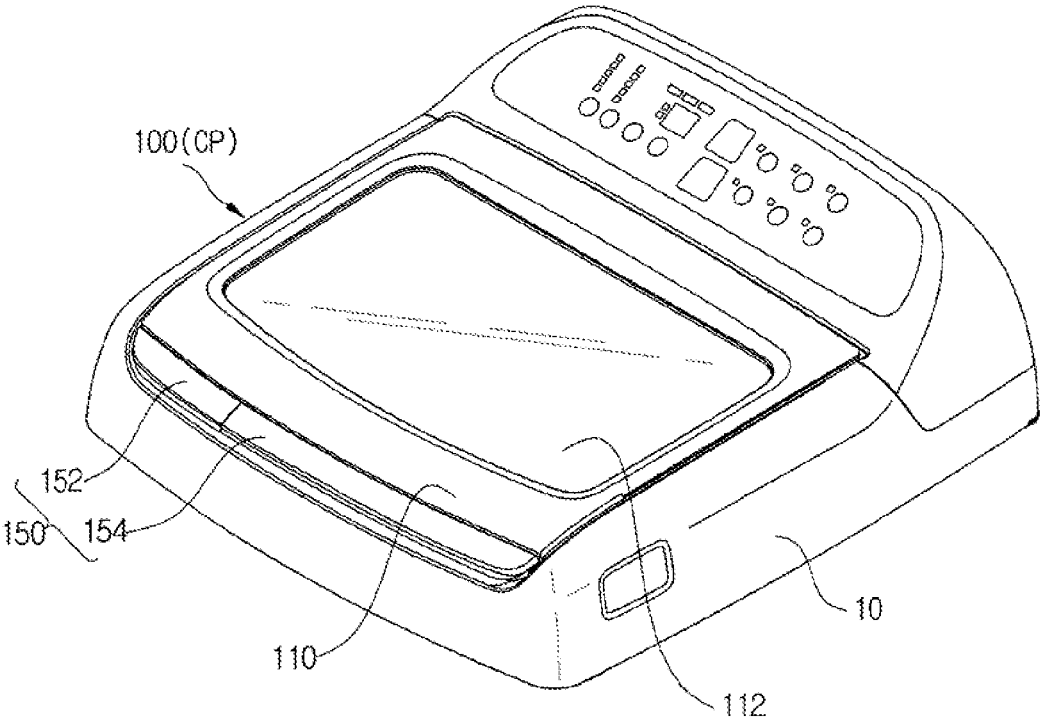
FIGS. 8A, 8B, and 8C illustrate an operation of the door assembly of the washing machine according to the first embodiment.
Figure 8B:
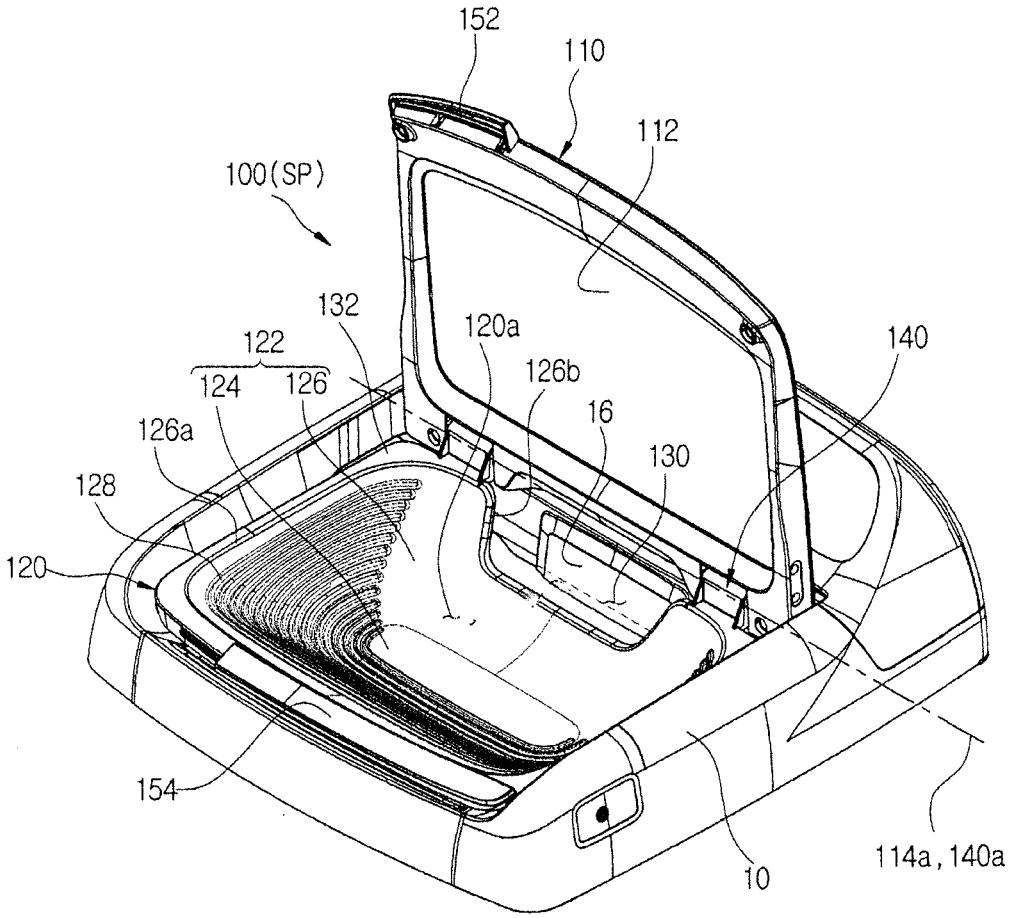
Figure 8C:
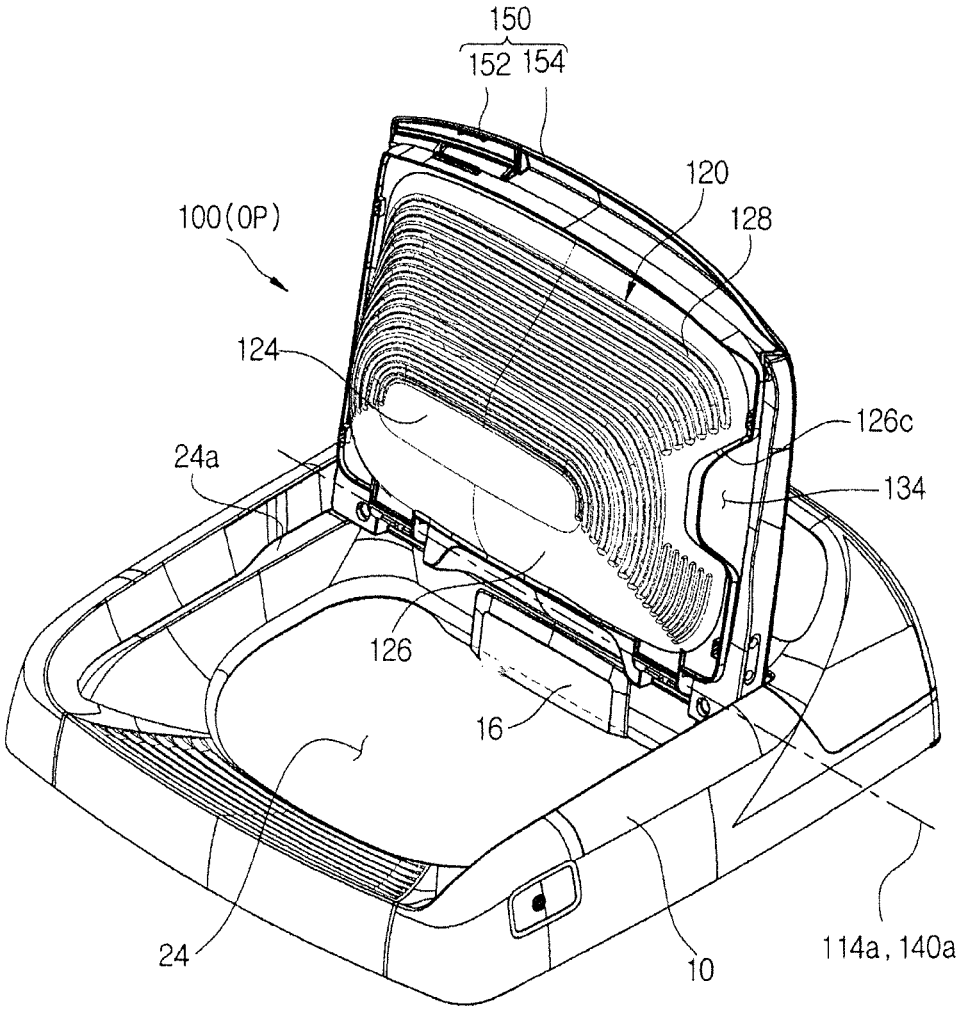

FIGS. 8A, 8B, and 8C illustrate an operation of the door assembly of the washing machine according to the first embodiment.

The door assembly 100 may be provided to be capable of pivoting to a closed position CP, an auxiliary washing position SP and an opened position OP. The closed position CP is a state which the door 110 and the auxiliary washing unit 120 are laid on the opening 24 so that the door assembly 100 closes the opening 24. The auxiliary washing position SP is a state which the door assembly 100 is disposed such that the door 110 pivots from the closed position CP and the auxiliary washing unit 120 is exposed for hand-washing. The opened position OP is a state which the door 110 and the auxiliary washing unit 120 pivot from the closed position CP or the auxiliary washing position SP so that the door assembly 100 opens the opening 24.

The door assembly 100 may be moved to the closed position CP or the auxiliary washing position SP through a manipulation of the door handle part 152, and the door assembly 100 may be moved to the closed position CP or the opened position OP through a manipulation of the auxiliary handle part 154.

Hereinafter, an operation of the auxiliary washing unit 120 of the washing machine 1 having the above configuration will be described.

Figure 9A:
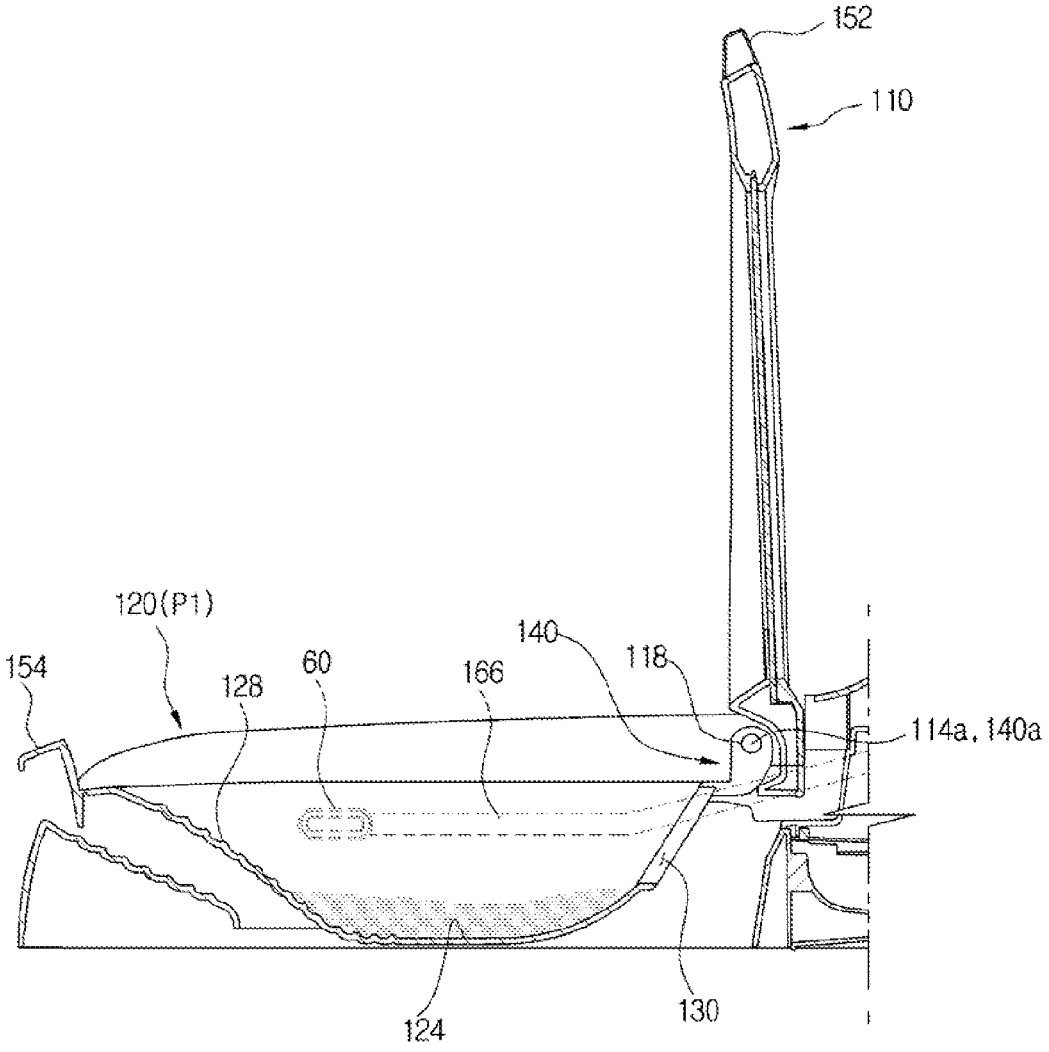
FIGS. 9A and 9B illustrate an operation of the auxiliary washing unit of the washing machine according to the first embodiment.
Figure 9B:
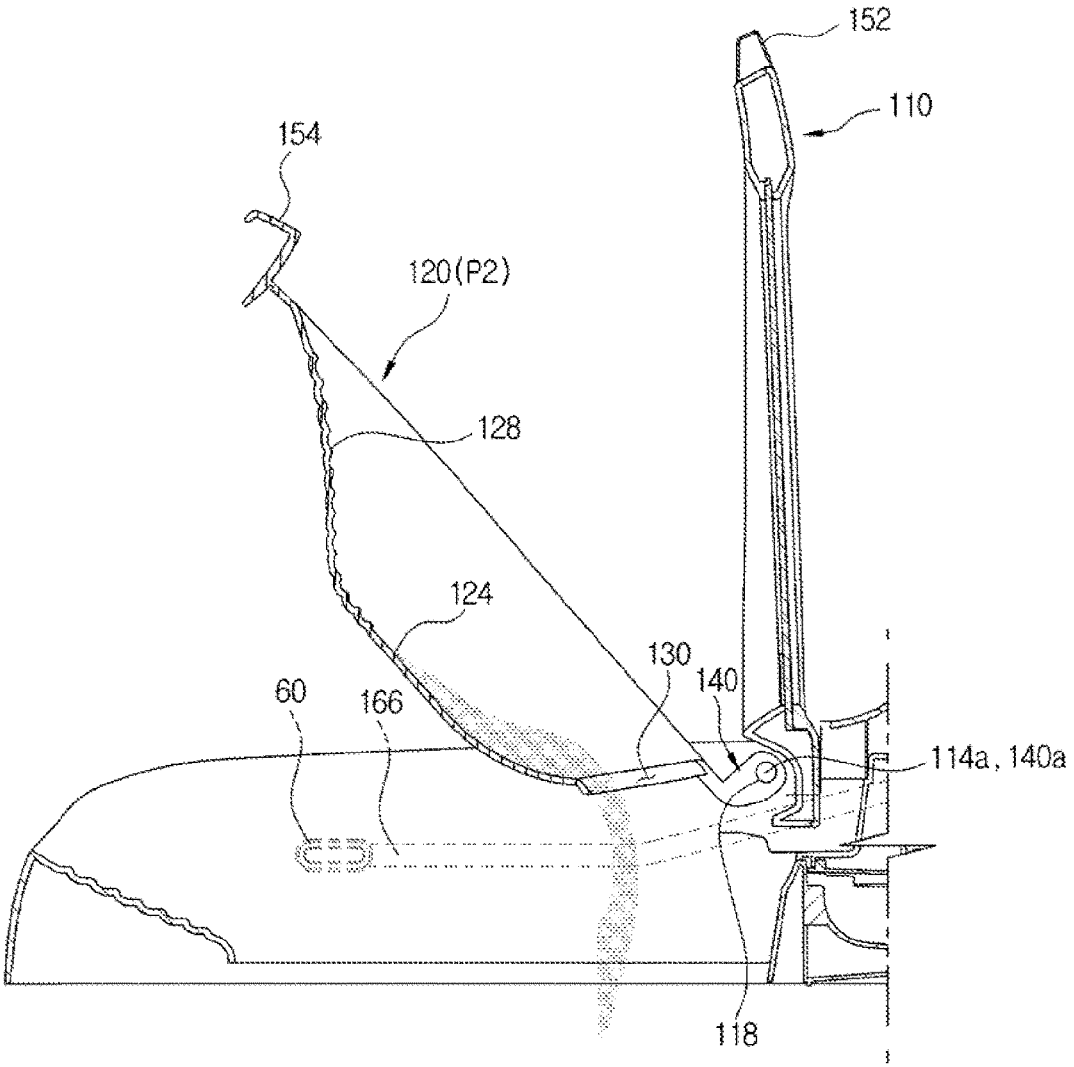

FIGS. 9A and 9B illustrate an operation of the auxiliary washing unit of the washing machine according to the first embodiment.

After hand washing is performed in the auxiliary washing position SP of the door assembly 100, the washing water may be discharged into the main washing space 11*a* through the auxiliary drain 130 or to an outside of the washing machine.

Specifically, if a position of the auxiliary washing unit 120 is called a first position P1 when the door assembly 100 is in the auxiliary washing position SP, the auxiliary washing unit 120 may be provided to pivot from the first position P1 to a second position P2 in which the auxiliary washing unit 120 pivots from the first position P1 so that the washing water in the auxiliary washing space 120*a* is discharged into the main washing space 11*a* through the auxiliary drain 130 or to the outside of the washing machine 1. The second position P2 is a position in which the auxiliary washing unit 120 has pivoted about the auxiliary pivot axis 140*a* and is tilted so that the washing water in the auxiliary washing space 120*a* is discharged through the auxiliary drain 130. The second position P2 may be any position between the first position P1 and the position of the auxiliary washing unit 120 when the door assembly 100 is in the opened position OP.

Since the auxiliary drain 130 may be formed in a portion lower than the adjacent side part 126, the washing water may be smoothly discharged through the auxiliary drain 130 without overflowing from the upper end of the side part 126 even when the auxiliary washing unit 120 is further tilted.

Hereinafter, a washing machine according to a second embodiment will be described.

Figure 10:
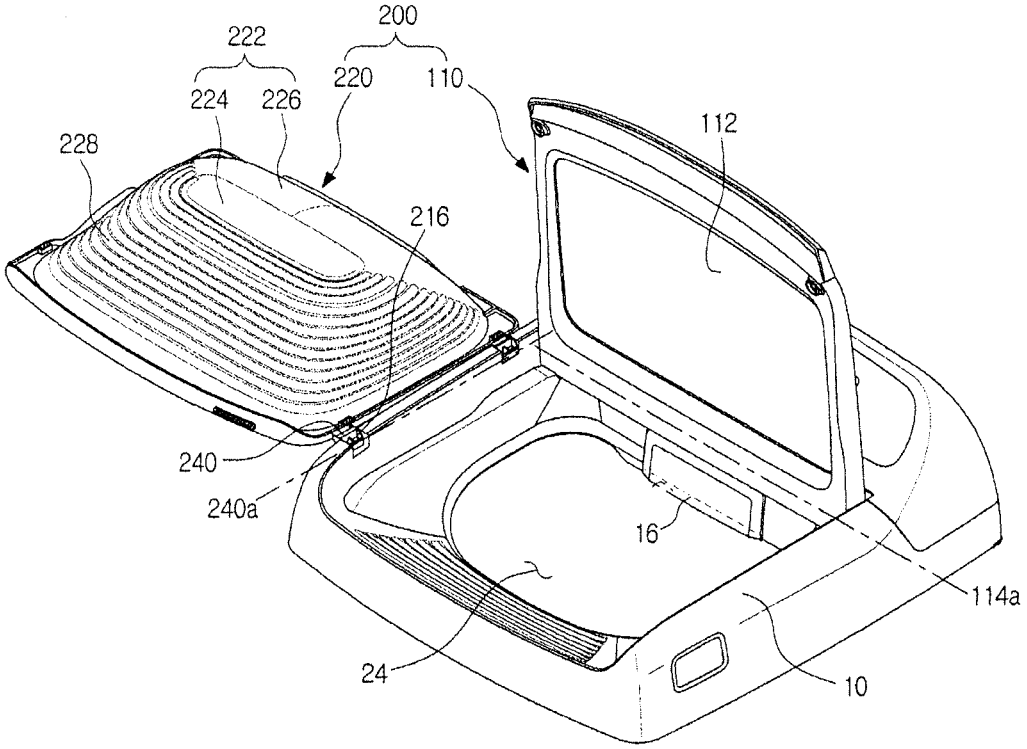
FIGS. 10 and 11 illustrate a door assembly of a washing machine according to a second embodiment and an operation of the door assembly.
Figure 11:
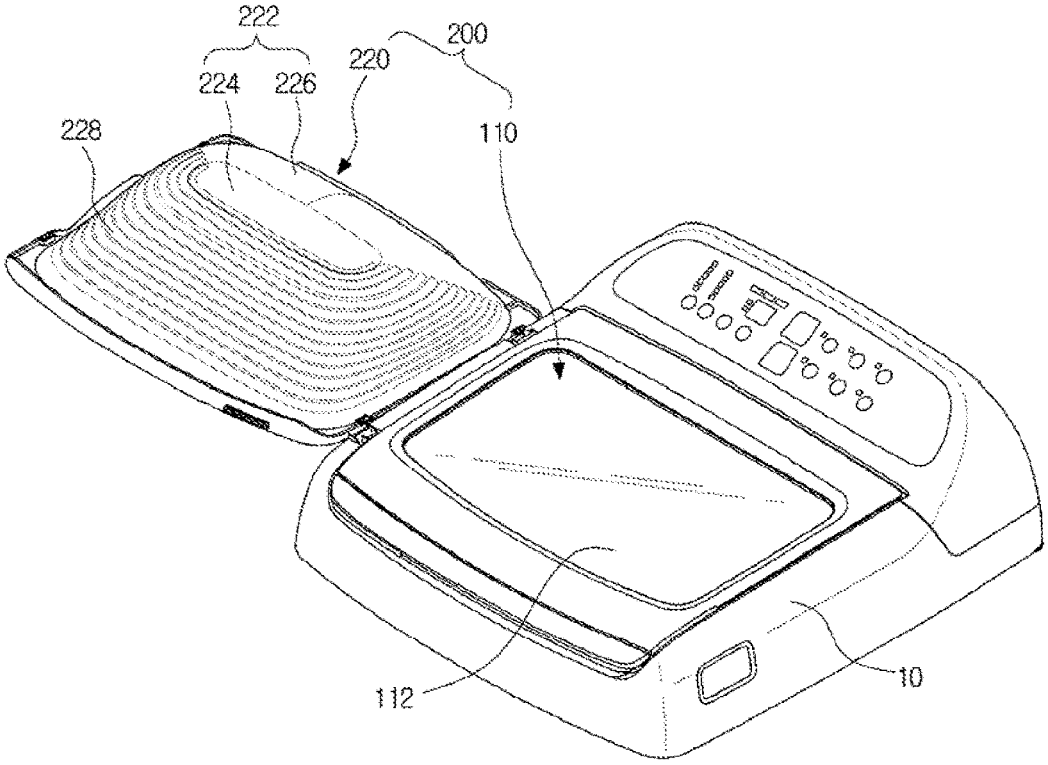

FIGS. 10 and 11 illustrate a door assembly of a washing machine according to a second embodiment and an operation of the door assembly.

Configurations of the present embodiment that are the same as those of the first embodiment will not be described again.

A door assembly 200 may include a door 110 and an auxiliary washing unit 220.

The auxiliary washing unit 220 may include a unit body 222 including a bottom part 224 and a side part 226.

The door 110 and the auxiliary washing unit 220 may both provided to be pivotable with respect to a main body 10.

The door 110 may be provided to be pivotable about a door pivot axis 114*a*, and the auxiliary washing unit 220 may be provided to be pivotable about an auxiliary pivot axis 240*a*.

In an embodiment, the door pivot axis 114*a* and the auxiliary pivot axis 240*a* may be provided to be disposed in different directions from an opening 24. That is, the door 110 and the auxiliary washing unit 220 may be provided to pivot in different directions. In the present embodiment, the door pivot axis 114*a* and the auxiliary pivot axis 240*a* may be provided to cross each other approximately perpendicularly, the door 110 may be provided to pivot in a forward/backward direction with respect to the main body 10, and the auxiliary washing unit 220 may be provided to pivot in a left/right direction with respect to the main body 10.

The auxiliary washing unit 220 includes an auxiliary pivot part 240.

The auxiliary pivot part 240 may be provided to protrude from the unit body 222 so that the auxiliary pivot axis 240*a* may be spaced apart from the unit body 222. Through this configuration, a rotational radius of the auxiliary washing unit 220 may be increased, and the unit body 222 may not interfere with the door 110 or the main body 10 when the auxiliary washing unit 220 pivots.

A recessed insertion part 216 may be formed in a side portion of the main body 10 so that the auxiliary pivot part 240 of the auxiliary washing unit 220 can pivot.

Through the configuration of the present embodiment, the door 110 and the auxiliary washing unit 220 may pivot in different directions so that the door 110 can be opened and closed even when the auxiliary washing unit 220 has pivoted to open the opening 24. That is, the auxiliary washing unit 220 and the door 110 may be provided to pivot independently.

Hereinafter, a washing machine according to a third embodiment will be described.

Figure 12:
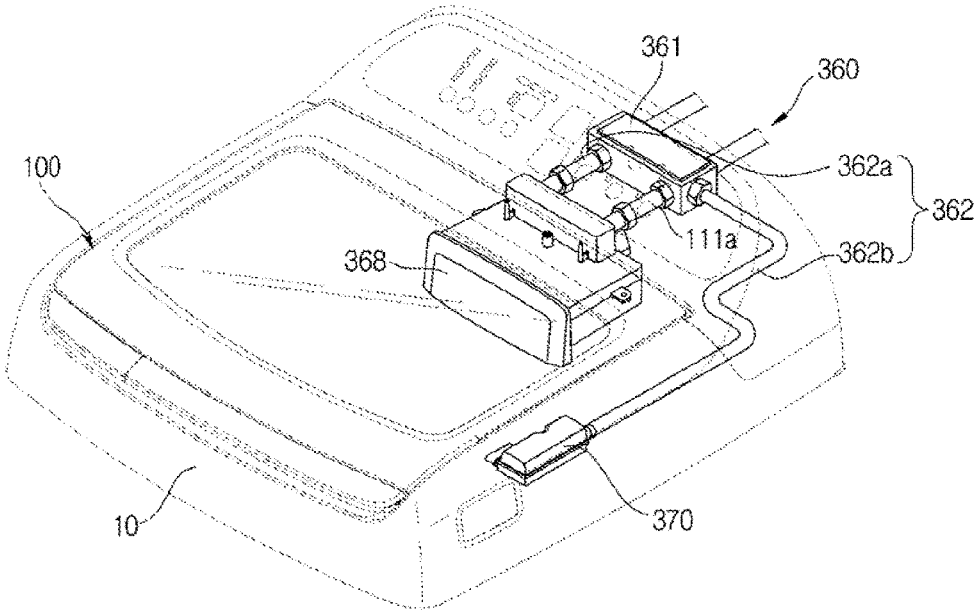
FIG. 12 is a perspective view of a water supply device according to a third embodiment.

FIG. 12 is a perspective view of a water supply device according to a third embodiment.

The washing machine according to the third embodiment may include a water supply device 360 for supplying water into a main washing space 11*a* and an auxiliary washing space 120*a*.

The water supply device 360 may include a water supply valve 361, a water supply pipe 362, a detergent supply device 368, and a washing water supply device 370. The water supply pipe 362 may include a main water supply pipe 362*a* and an auxiliary water supply pipe 362*b*.

The water supply valve 361 may be disposed in a main body in order to supply washing water into the main body from the outside of the main body.

The water supply valve 361 may control water supply to the detergent supply device 368 and water supply to the washing water supply device 370. The water supply valve 361 may be configured to independently control water supply to the detergent supply device 368 and water supply to the washing water supply device 370 and may separately control water supply for the main washing and auxiliary washing. Water supply to the washing water supply device 370 may be controlled using an input button (not shown). Also, a user may control water supply to the washing water supply device 370 by stepping on input pedal (not shown) installed at a lower portion of a main body of the washing machine. However, embodiments are not limited to these examples, and water supply to the washing water supply device 370 may be controlled using various structures and methods.

The water supply valve 361 may be connected to the detergent supply device 368 and the washing water supply device 370 through the main water supply pipe 362*a* and the auxiliary water supply pipe 362*b*, respectively. The washing water supply device 370 will be described later in detail.

The auxiliary washing unit 120 may include a washing water inlet 134 through which the washing water guided through the water supply valve 361 and the auxiliary water supply pipe 362*b* may be supplied to the auxiliary washing unit 120 via the washing water supply device 370, to correspond to the auxiliary water supply port 60. The washing water inlet 134 may be formed by an inlet edge 126*c* formed to be lower than the adjacent upper end 126*a* of the unit body 122. That is, the washing water inlet 134 may be formed in the shape that a portion of the side part is recessed from the upper end 126*a* of the unit body 122. However, the shape of the washing water inlet 134 is not limited as long as the washing water can be introduced into the auxiliary washing space 120*a* without interference with by the unit body 122 when the washing water is introduced through the washing water supply device 370.

The auxiliary washing unit 120 may be formed of a thermoplastic resin. The auxiliary washing unit 120 may be formed of an ABS material. However, the material for the auxiliary washing unit 120 is not limited thereto, and the auxiliary washing unit 120 may be formed of any material having sufficient shock resistance and rigidity required for hand-washing.

The washing water supply device 370 may be disposed to supply the washing water to the auxiliary washing unit 120. The washing water supply device 370 may be disposed to supply the washing water into the auxiliary washing space 120*a* through the washing water inlet 134 concavely formed in the auxiliary washing unit 120.

The washing water supply device 370 may be disposed at a side to the auxiliary washing unit 120 so that the washing water may be supplied to a side portion of the auxiliary washing unit 120. However, embodiments are not limited thereto, and the washing water supply device 370 may be disposed to supply water to the auxiliary washing unit 120 in a different direction, as will be described in the following embodiment.

Figure 13:
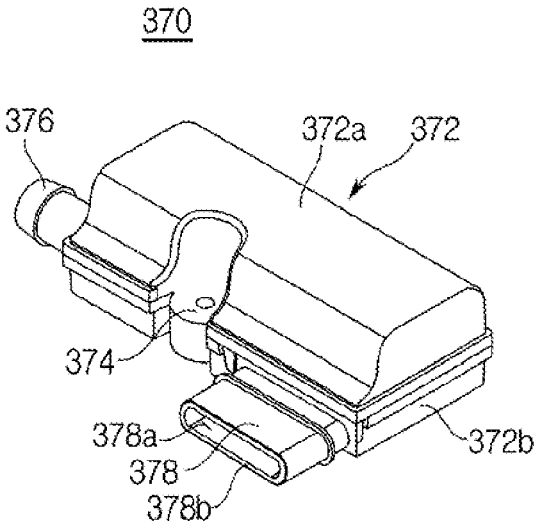
FIG. 13 is a perspective view of a washing water supply device according to the third embodiment.
Figure 14:
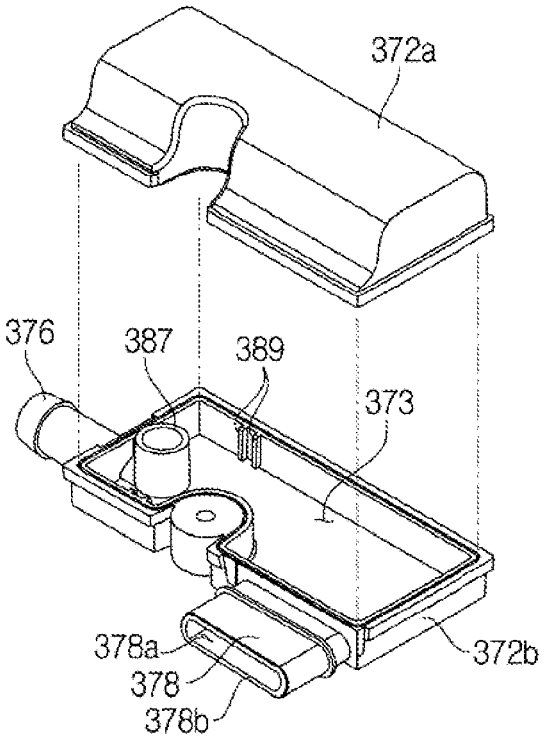
FIG. 14 is an exploded perspective view of the washing water supply device according to the third embodiment.
Figure 15:
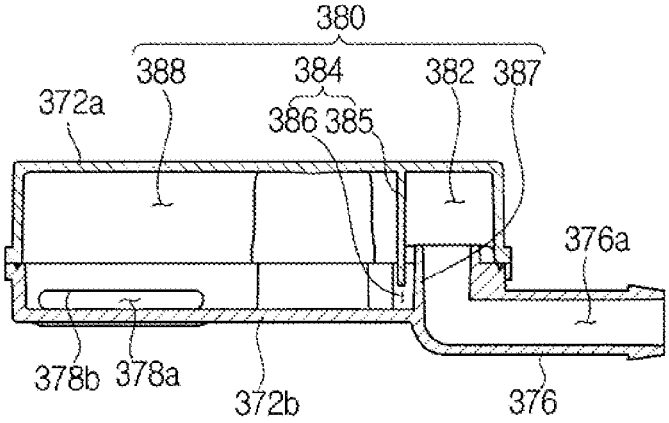
FIG. 15 is a cross-sectional view of the washing water supply device according to the third embodiment.

FIG. 13 is a perspective view of a washing water supply device according to the third embodiment, FIG. 14 is an exploded perspective view of the washing water supply device according to the third embodiment, and FIG. 15 is a cross-sectional view of the washing water supply device according to the third embodiment.

The washing water supply device 370 may include a housing 372, and an inlet port 376 and an outlet port 378 that are disposed in the housing 372.

The housing 372 may have an approximately hexahedral shape in an embodiment. However, the shape of the housing 372 is not limited. The housing 372 may include an upper housing 372*a* and a lower housing 372*b* and may form an internal space 373 by coupling the upper housing 372*a* and the lower housing 372*b*.

A coupling hole 374 for coupling with the inside of the main body may be formed in the housing 372 and the housing 372 may be coupled with the inside of the main body using screw coupling.

The inlet port 376 may be connected to the water supply valve 361 and may guide the washing water supplied from the water supply valve 361 to the housing 372. The washing water may be introduced into the housing 372 through the inlet port 376. The outlet port 378 may be disposed to communicate with an inside of the housing 372 so that the washing water can be discharged into the auxiliary washing unit 120. An inlet flow path 376*a* through which the washing water is introduced may be formed in the inlet port 376.

The outlet port 378 may be disposed in a direction perpendicular to the inlet port 376 so that water can be supplied to sides of the auxiliary washing unit 120 in an embodiment. However, the outlet port 378 may be disposed in the same direction as the inlet port 376, as in the following embodiment, or may be disposed in a different direction from that of the first embodiment. An outlet flow path 379*a* through which the washing water is discharged may be formed in the outlet port 378. Also, an outlet opening 379*b* that communicates with the outside may be formed in an end of the outlet port 378.

A water pressure regulation device 380 may be disposed in the housing 372 to regulate pressure of the washing water introduced into the housing 372 through the inlet port 376.

The water pressure regulation device 380 may include a water pressure regulation chamber 382 and a water pressure regulation part 384.

The water pressure regulation chamber 382 may be disposed so that the washing water introduced from the inlet port 376 can be stored in the water pressure regulation chamber 382. That is, the water pressure regulation chamber 382 may be disposed so that pressure of the washing water can be reduced while the washing water introduced from the inlet port 376 is temporarily stored in the water pressure regulation chamber 382. The water pressure regulation chamber 382 may be disposed to be spaced apart from the outlet port 378 and to communicate with the inlet port 376.

The water pressure regulation chamber 382 may have a larger width than those of the inlet port 376 or an extension pipe 387 that will be described later. Thus, a flow velocity and water pressure of the washing water can be reduced through an enlarged cross-sectional area of the water pressure regulation chamber 382 while a quantity of water supply is constant.

The water pressure regulation part 384 may be formed between and partition the water pressure regulation chamber 382 and a discharge chamber 388 that will be described later. Also, the washing water that flows from the water pressure regulation chamber 382 to the discharge chamber 388 may be throttled so that the pressure of the washing water can be adjusted and the flow rate of the washing water can be adjusted.

The water pressure regulation part 384 may include an adjustment rib 385 and a water pressure regulation hole 386.

The adjustment rib 385 may be disposed at one side of the water pressure regulation chamber 382 so that the water pressure regulation chamber 382 can be formed. In detail, the internal space 373 of the housing 372 may include the water pressure regulation chamber 382 and the discharge chamber 388. The adjustment rib 385 may be disposed to partition the water pressure regulation chamber 382 and the discharge chamber 388. The discharge chamber 388 may be disposed in the housing 372 to be spaced apart from the inlet port 376 and may be formed to communicate with the outlet port 378.

The adjustment rib 385 may be provided on an inner surface of the housing 372 to extend from the housing 372 or may be provided in the housing 372 to block at least a portion of the washing water moving from the water pressure regulation chamber 382 to the discharge chamber 388. Through this configuration, the adjustment rib 385 may be provided so that the washing water moving from the water pressure regulation chamber 382 to the discharge chamber 388 moves only through the water pressure regulation hole 386 that will be described later.

The arrangement of the adjustment rib 385 is not limited. However, in the present embodiment, the adjustment rib 385 may be provided to be perpendicular to a direction in which the washing water progresses.

The extension pipe 387 that extends from the inlet port 376 may be disposed in the water pressure regulation chamber 382. The extension pipe 387 may be formed to be bent from the inlet port 376. In detail, the extension pipe 387 may be provided to be bent upward from an inside of the water pressure regulation chamber 382.

As a discharge port of the extension pipe 387 may be provided to discharge the washing water upward from the inside of the water pressure regulation chamber 382, pressure of the washing water can be reduced while the washing water that flows through the inlet port 376 and the extension pipe 387 collides with an inner surface of an upper portion of the housing 372.

The water pressure regulation device 380 may include the water pressure regulation hole 386 through which the washing water can move from the water pressure regulation chamber 382 to the discharge chamber 388. The water pressure regulation hole 386 may be formed on the same plane as the adjustment rib 385.

The adjustment rib 385 may extend from a top surface of the inner surface of the housing 372 toward a bottom surface of the inner surface of the housing 372. The water pressure regulation hole 386 may be formed by an end of the adjustment rib 385 and the inner surface of the housing 372. In detail, the adjustment rib 385 may be formed by the end of the adjustment rib 385 and the bottom surface of the housing 372. The washing water in the water pressure regulation chamber 382 may be discharged into the discharge chamber 388 through the water pressure regulation hole 386.

The water pressure regulation hole 386 may be formed so that the washing water can pass through the water pressure regulation hole 386 in the same direction in which the washing water passes through the inside of the inlet port 376. That is, because a direction of the inlet port 376 and a direction of the washing water that passes through the water pressure regulation hole 386 are aligned, the direction in which the washing water progresses need not be changed to regulate water pressure and the washing water can continue in the same direction.

Also, the water pressure regulation hole 386 may be disposed in a lower portion of the water pressure regulation chamber 382. The outlet of the extension pipe 387 may be provided to face upward from an inside of the water pressure regulation chamber 382. The water pressure regulation hole 386 may be disposed in the lower portion of the water pressure regulation chamber 382 so that the washing water discharged through the outlet of the extension pipe 387 can be discharged through the water pressure regulation hole 386 while bypassing the inside of the water pressure regulation chamber 382 rather than being directly discharged through the water pressure regulation hole 386. However, the arrangement of the water pressure regulation hole 386 is not limited thereto, and any arrangement in which the water pressure regulation hole 386 is disposed on the same plane as the adjustment rib 385 may be used.

The adjustment rib 385 and the water pressure regulation hole 386 may serve as a throttling device that performs a throttling action between the water pressure regulation chamber 382 and the discharge chamber 388. That is, the water pressure regulation hole 386 may have a smaller cross-sectional area than that of the housing 372 with respect to the direction in which the washing water is flowing so that pressure of the washing water can be reduced by throttling. Pressure and a flow rate of the washing water may be regulated by the throttling action in the water pressure regulation hole 386.

The size of the water pressure regulation hole 386 is not limited but any size smaller than cross-sectional areas of the water pressure regulation chamber 382 and the discharge chamber 388 may be possible. In the present embodiment, widths of the water pressure regulation chamber 382, the water pressure regulation hole 386, and the discharge chamber 388 are the same, and the height of the water pressure regulation hole 386 is 2 to 3 mm. However, embodiments are not limited thereto.

The adjustment rib 385 may be disposed in the upper housing 372*a*, and a reinforcement rib 389 may be disposed in the lower housing 372*b* to guide at least a portion of the adjustment rib 385. At least a portion of the reinforcement rib 389 may be formed along an edge of the adjustment rib 385 to prevent the adjustment rib 385 from being deformed by pressure of the washing water. In the present embodiment, the reinforcement rib 389 may be disposed in a forward/backward direction of the adjustment rib 385. However, the reinforcement rib 389 may be disposed in one of the forward and backward directions.

Figure 16:
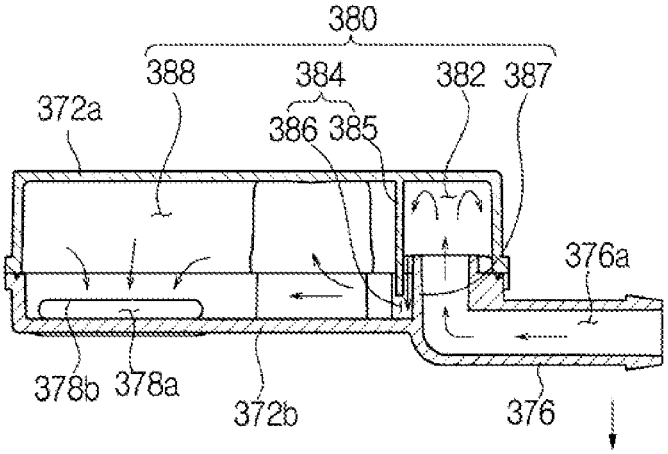
FIG. 16 is a view of the flow of washing water in the washing water supply device according to the third embodiment.

FIG. 16 is a view of the flow of washing water in the washing water supply device according to the third embodiment.

If the water supply valve 361 is opened, the washing water may be guided to the washing water supply device 370 through the auxiliary water supply pipe 362*b*.

The washing water introduced through the auxiliary water supply pipe 362*b* may be introduced into the water pressure regulation chamber 382 through the inlet port 376 and the extension pipe 387. Since the width of the internal space 373 of the water pressure regulation chamber 382 is larger than the width of a flow path through which the washing water flows in the inlet port 376 and the extension pipe 387, a flow velocity can be reduced and pressure of the washing water can be reduced while the washing water is discharged from the inlet port 376 and the extension pipe 387 to the water pressure regulation chamber 382.

Also, the extension pipe 387 may be bent upward in the water pressure regulation chamber 382 and pressure of the washing water can be reduced while the washing water moves upward.

The washing water discharged into the water pressure regulation chamber 382 from the inlet port 376 and the extension pipe 387 may be temporarily stored in the water pressure regulation chamber 382. The stored washing water may be discharged to the discharge chamber 388 through the water pressure regulation hole 386.

The adjustment rib 385 may be disposed between the water pressure regulation chamber 382 and the discharge chamber 388 and thus may prevent the washing water from moving from the inside of the water pressure regulation chamber 382 to the discharge chamber 388.

Since cross-sectional widths of the water pressure regulation chamber 382 and the discharge chamber 388 that are perpendicular to the lengthwise direction of the housing 372 may be larger than the width of the water pressure regulation hole 386, the washing water may be throttled by the adjustment rib 385 and the water pressure regulation hole 386. In this procedure, pressure of the washing water is reduced.

The washing water discharged to the discharge chamber 388 flows out through the outlet port 378 and may be supplied to the auxiliary washing unit 120.

Hereinafter, a washing water supply device according to a fourth embodiment and a washing machine having the same will be described.

Figure 17:
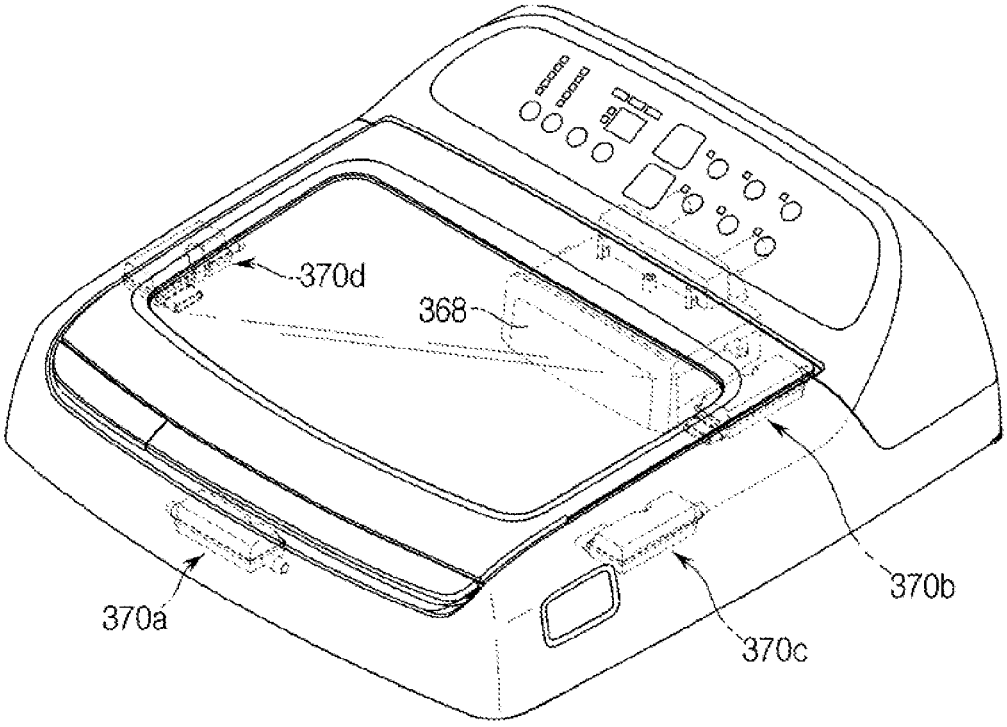
FIG. 17 is a perspective view of a washing machine according to a fourth embodiment.
Figure 18A:
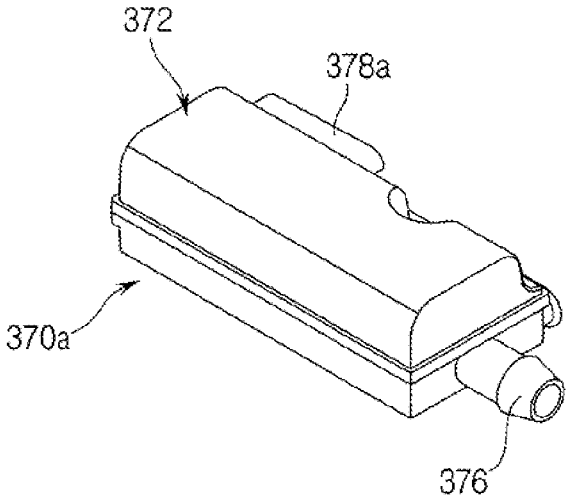
FIGS. 18A, 18B, and 18C are perspective views of a washing water supply device according to the fourth embodiment.
Figure 18B:
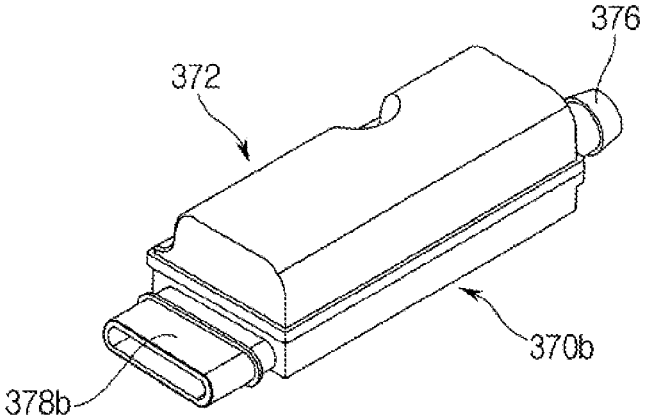
Figure 18C:
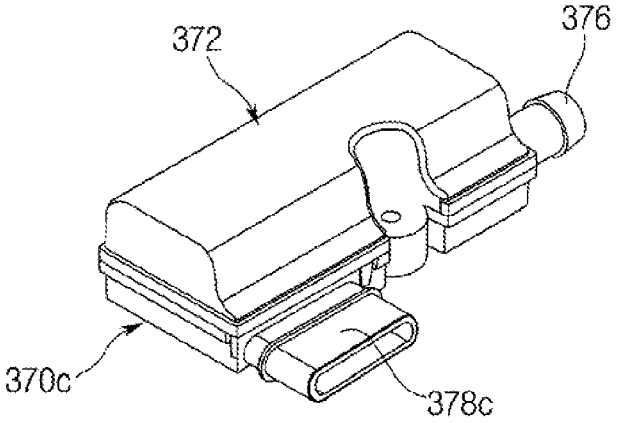

FIG. 17 is a perspective view of a washing machine according to a fourth embodiment, and FIGS. 18A, 18B, and 18C are perspective views of a washing water supply device according to the fourth embodiment.

Configurations that are the same as those of the third embodiment will be not be described again.

In the third embodiment, the washing water supply device 370 may be disposed at a side of an auxiliary washing unit 120. In the present embodiment, the washing water supply device 370 may not be disposed in one side of the auxiliary washing unit 120, like in the third embodiment, but washing water supply devices 370*a*, 370*b*, 370*c*, and 370*d* may be disposed in at least one of front, rear, and sides of the auxiliary washing unit 120.

For convenience of explanation, in FIG. 17, the washing water supply devices 370*a*, 370*b*, 370*c*, and 370*d* may be disposed at all of front, rear, and sides of the auxiliary washing unit 120. However, they may be disposed in at least one thereof.

When the washing water supply devices 370*a*, 370*b*, 370*c*, and 370*d* are disposed at front 370*a*, rear 370*b*, and sides 370*c* and 370*d* of the auxiliary washing unit 120, respectively, the washing water can be supplied to the auxiliary washing unit 120 in more diverse directions to improve water supply efficiency.

An arrangement of outlet ports 378*a*, 378*b*, and 378*d* may be changed by changing an arrangement of the washing water supply devices 370*a*, 370*b*, 370*c*, and 370*d*. The washing water supply device 370*c* disposed at the side of the auxiliary washing unit 120 has the same configuration as that in the third embodiment and thus a description thereof will be omitted.

In the present embodiment, when the washing water supply device 370*b* is disposed at a rear side of the auxiliary washing unit 120, the outlet port 378*b* may be disposed in the same direction as the lengthwise direction of the housing 372. When the washing water supply device 370*a* is disposed at a front side of the auxiliary washing unit 120 and the washing water supply device 370*c* is disposed at one side of the auxiliary washing unit 120, the outlet port 378*a* may be disposed in the same direction as in the third embodiment. When the washing water supply device 370*d* is disposed at the other side of the auxiliary washing unit 120, the outlet port 378*d* may be disposed in an opposite direction to that of the third embodiment.

The washing water supply devices 370*a*, 370*b*, 370*c*, and 370*d* have been differentiated in this way only for convenience of explanation. Embodiments are not limited thereto, and a direction of the outlet port with respect to the housing may be changed according to an arrangement of the washing water supply devices.

Hereinafter, a washing water supply device according to a fifth embodiment and a washing machine having the same will be described.

Figure 19:
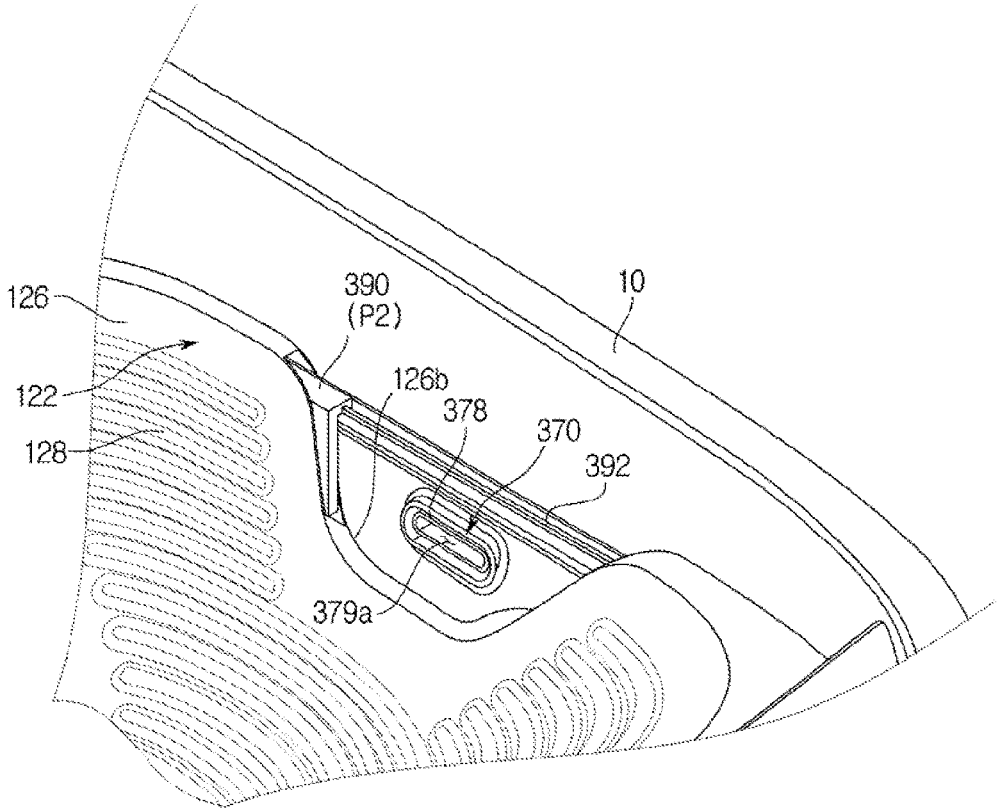
FIGS. 19 and 20 are views of an operation of an opening and closing device of a washing machine according to a fifth embodiment.
Figure 20:
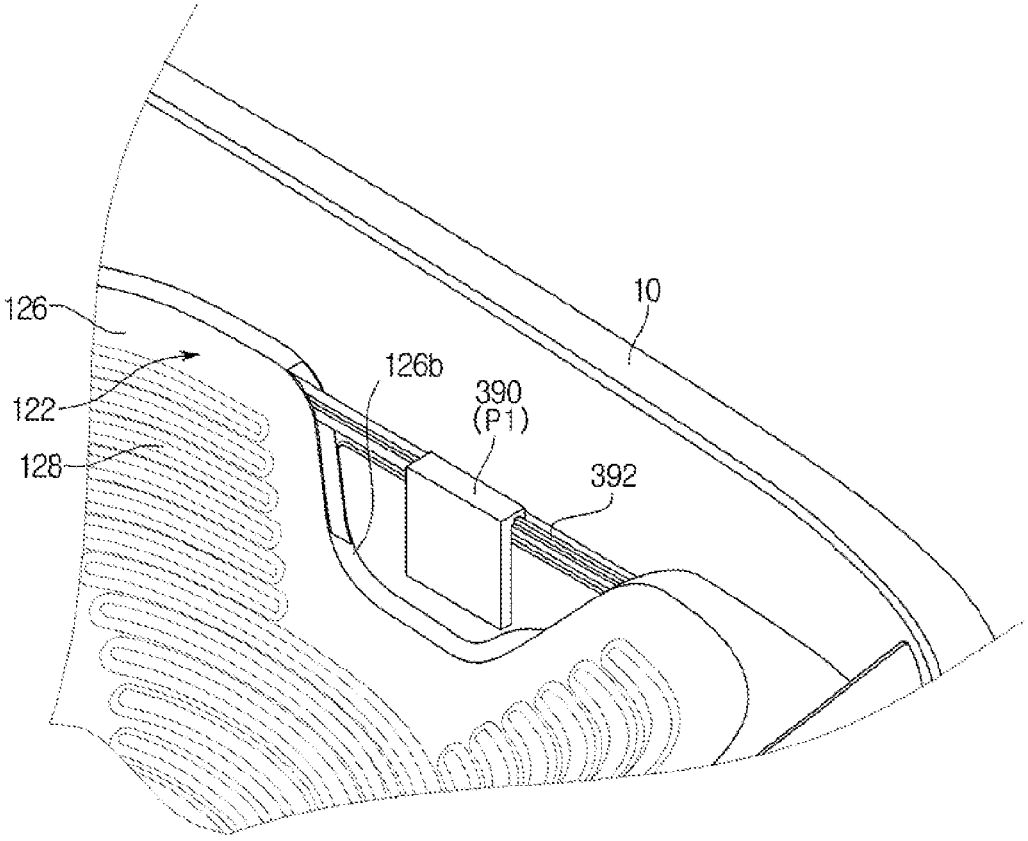

FIGS. 19 and 20 are views of an operation of an opening and closing device of a washing machine according to a fifth embodiment.

In the present embodiment, the washing water supply device 370 may include an opening and closing member 390 that opens and closes the outlet port 378.

The opening and closing member 390 may be disposed to open and close the outlet opening 379*b* of the outlet port 378 so that the washing water supplied from the washing water supply device 370 can be controlled by the opening and closing member 390 as well as the water supply valve 361.

In the present embodiment, the opening and closing member 390 may be configured to be moved in a sliding manner and to open and close the outlet port 378. In detail, the opening and closing member 390 may be slidably provided between a first position P1 in which the outlet opening 379*b* of the outlet port 378 is closed, and a second position P2 in which the outlet opening 379*b* of the outlet port 378 is opened. The opening and closing member 390 may be configured to slide along a guide rail 392 provided such that the opening and closing member 390 can move between the first position P1 and the second position P2 through a reciprocal movement along the guide rail 392. However, embodiments are not limited thereto, and any manner of opening and closing the outlet opening 379*b* of the outlet port 378 may be used by the opening and closing member 390.

Hereinafter, a washing water supply device according to a sixth embodiment and a washing machine having the same will be described.

Figure 21:
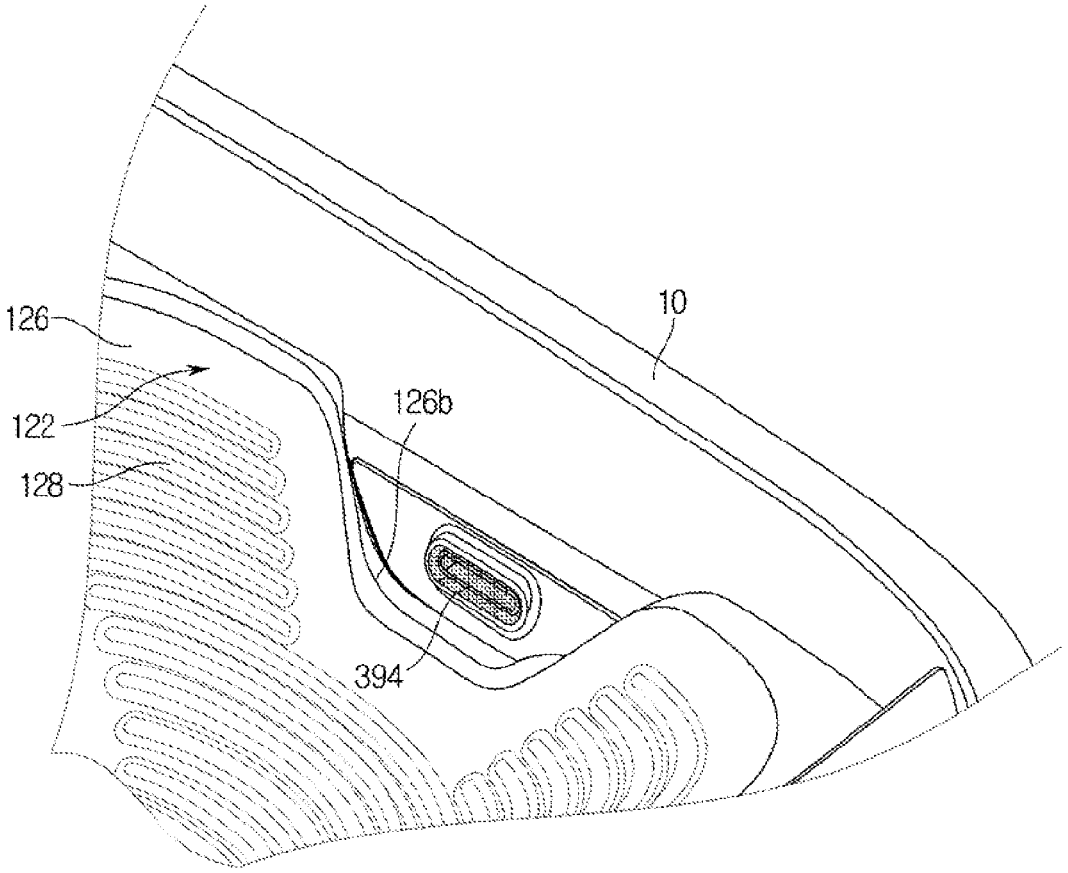
FIG. 21 is a partial perspective view of a washing machine according to a sixth embodiment.

FIG. 21 is a partial perspective view of a washing machine according to a sixth embodiment.

In the present embodiment, the washing machine may include a discharge guide 394 that prevents the washing water from being scattered around a periphery of the outlet port 378 while the washing water is discharged into the auxiliary washing unit through the outlet port 378.

The discharge guide 394 may be disposed on the outlet opening 379*b* of the outlet port 378.

In the present embodiment, the discharge guide 394 may be disposed in front of an opening through which the washing water is discharged from the outlet port 378, and may be formed as a mesh grill. The discharge guide 394 may be disposed in a path along which the washing water progresses and may guide progression of the washing water discharged through the outlet port 378 so that the washing water can be prevented from splattering on the periphery of the outlet port 378 while the washing water is discharged.

In detail, the discharge guide 394 may be disposed in front of the outlet port 378 in a direction perpendicular to the direction in which the washing water progresses so that the washing water can be discharged only through the discharge guide 394. Through this configuration, the washing water can be uniformly discharged through the outlet port 378.

Hereinafter, a washing water supply device according to a seventh embodiment and a washing machine having the same will be described.

Figure 22:
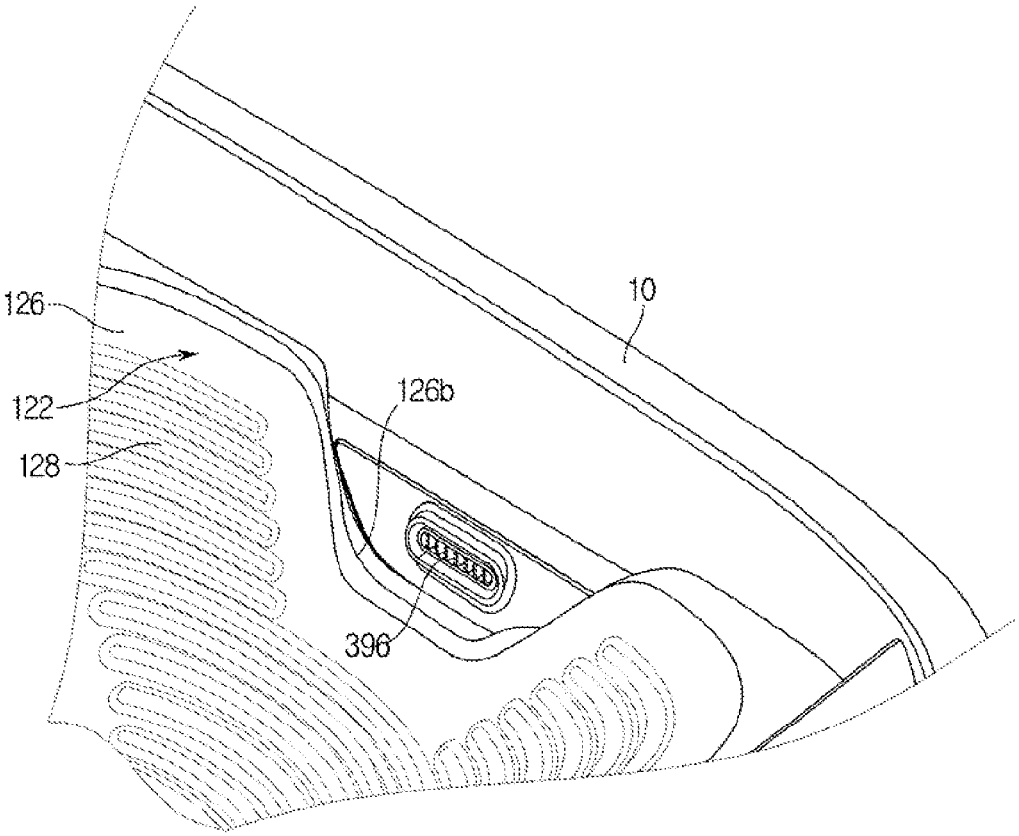
FIG. 22 is a partial perspective view of a washing machine according to a seventh embodiment.

FIG. 22 is a partial perspective view of a washing machine according to a seventh embodiment.

In the present embodiment, the washing machine may include a discharge guide 396 that prevents the washing water from being scattered around the periphery of the outlet port 378 while the washing water is discharged into the auxiliary washing unit 120 through the outlet port 378.

The discharge guide 396 may be disposed in front of the outlet opening 379*b* of the outlet port 378.

In the present embodiment, the discharge guide 396 may be disposed in front of the outlet opening 379*b* of the outlet port 378 and may be formed as a plurality of ribs parallel with each other. The discharge guide 396 may be disposed in the path along which the washing water progresses and may guide progression of the washing water discharged through the outlet port 378 so that the washing water can be prevented from being scattered around the periphery of the outlet port 378 while the washing water is discharged.

In detail, the discharge guide 396 may be disposed in front of the outlet port 378 in a direction perpendicular to the direction in which the washing water progresses so that the washing water can be discharged only through the discharge guide 396. Through this configuration, the washing water can be uniformly discharged through the outlet port 378.

Hereinafter, a washing machine according to an eighth embodiment will be described.

Figure 23:
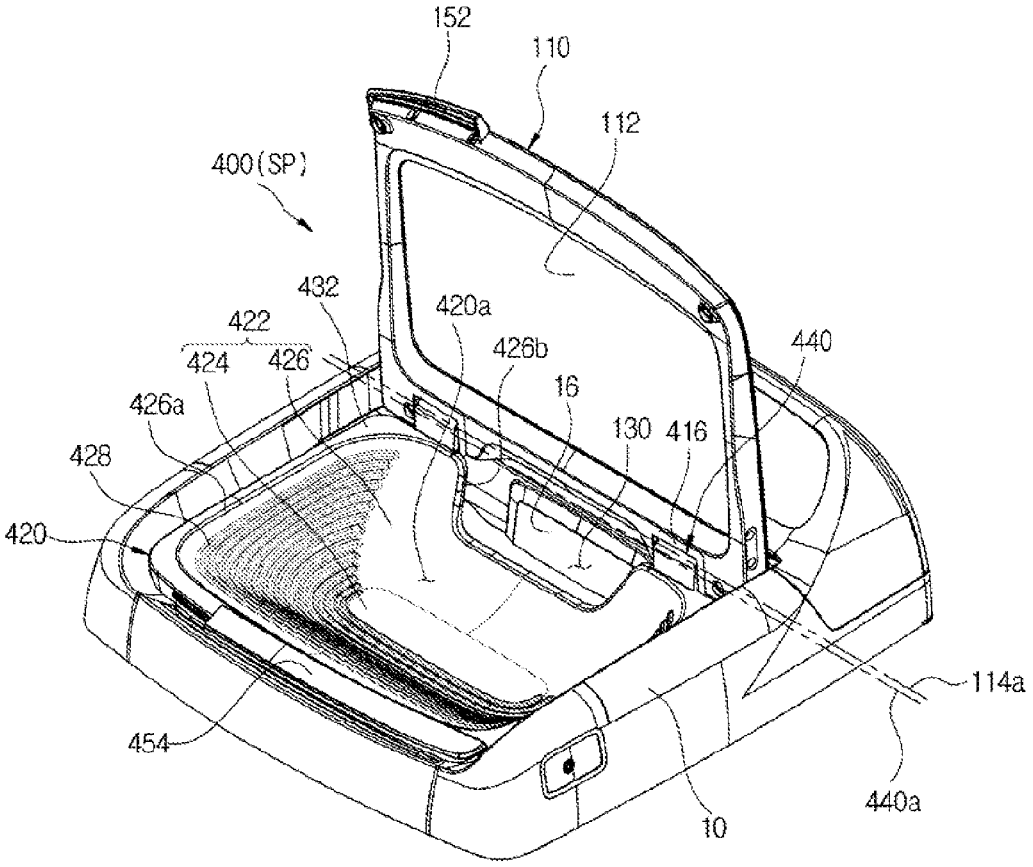
FIG. 23 is a partial perspective view of a washing machine according to an eighth embodiment.
Figure 24:
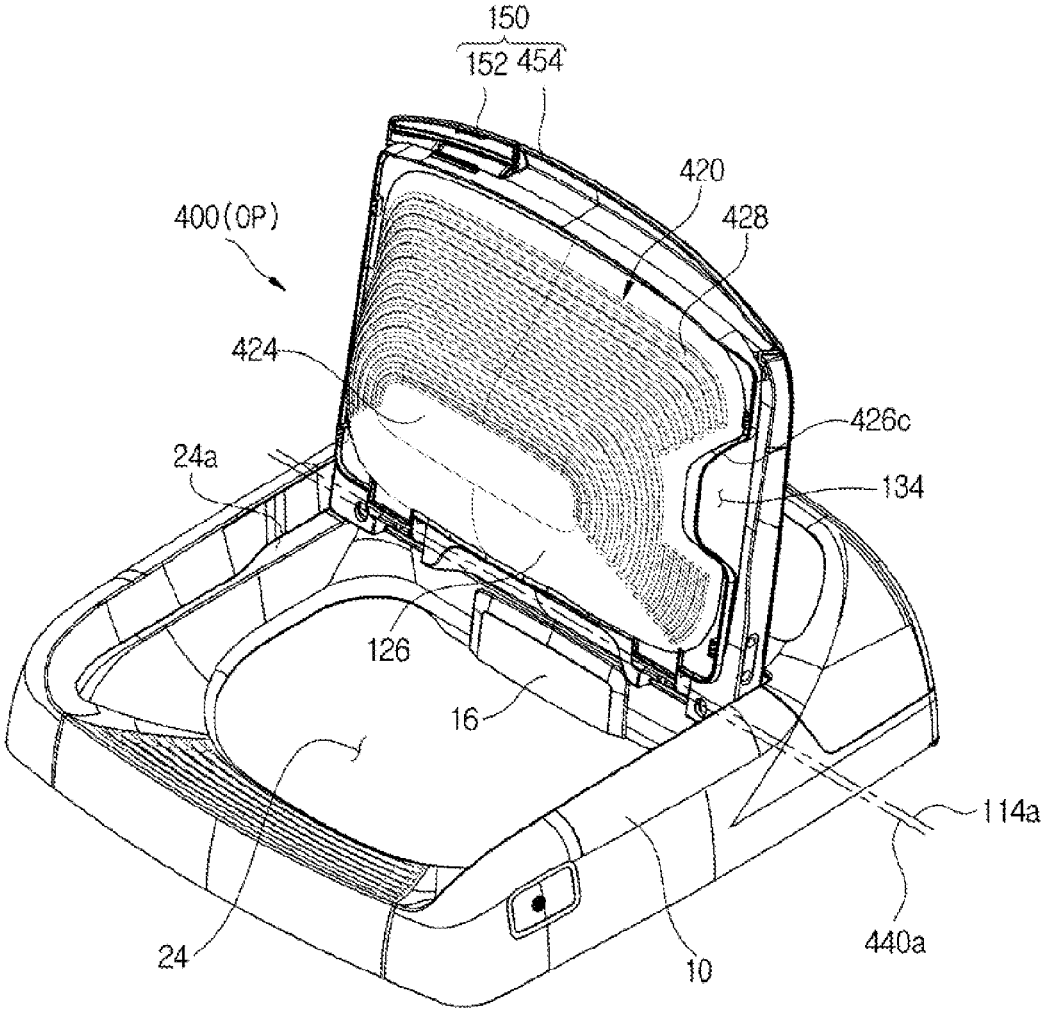
FIG. 24 is a partial perspective view of the washing machine according to the eighth embodiment.

FIGS. 23 and 24 are views of a door assembly of a washing machine according to the eighth embodiment and an operation of the door assembly.

Configurations of the present embodiment that are the same as those of the first embodiment will not be described again.

A door assembly 400 may include a door 110 and an auxiliary washing unit 420.

The auxiliary washing unit 420 may include a unit body 422 including a bottom part 424 and a side part 426.

The door 110 and the auxiliary washing unit 420 may both be provided to pivot with respect to the main body 10.

The door 110 may be provided to be pivotable about a door pivot axis 114*a*, and the auxiliary washing unit 420 may be provided to be pivotable about an auxiliary pivot axis 440*a*.

In the current embodiment, the door pivot axis 114*a* and the auxiliary pivot axis 440*a* may be provided in parallel with each other, that is, not to coincide with each other. That is, the door pivot axis 114*a* and the auxiliary pivot axis 440*a* may be provided to be spaced apart from each other in parallel.

In the present embodiment, the auxiliary pivot axis 440*a* may be disposed in front of the door pivot axis 114*a*. The auxiliary pivot axis 440*a* may be provided to be spaced apart from a body of the door 110. In detail, an insertion part of the door 110 may be provided to protrude forward from the body of the door 110 so that an auxiliary pivot part 440 of the auxiliary washing unit 420 can be coupled to the door 110 while spaced apart from the body of the door 110.

Through this configuration, the auxiliary pivot axis 440*a* that is a rotation center of the auxiliary washing unit 420 may be disposed further forward than the auxiliary pivot axis 140*a* of the first embodiment, and thus a range of pivotal movement of the auxiliary washing unit 420 may be wider than that of the auxiliary pivot axis 140*a* of the first embodiment. Also, with respect to the door 110, the range of pivotal movement of the auxiliary washing unit 420 may be wider than that of the door 110.

In the present embodiment, the auxiliary pivot axis 440*a* may be disposed further forward than the door pivot axis 114*a*. However, embodiments are not limited thereto, and the auxiliary pivot axis 440*a* may be disposed in a lower or higher position than that of the door pivot axis 114*a*.

The auxiliary washing unit 420 may include an auxiliary pivot part 440.

The auxiliary pivot part 440 may be provided to protrude from the unit body 422 so that the auxiliary pivot axis 440*a* is spaced apart from the unit body 422. Through this configuration, a rotational radius of the auxiliary washing unit 420 may be increased. The unit body 422 may not be interfered with by the door 110 or the main body 10 when the auxiliary washing unit 420 pivots.

An insertion part 416 may be formed concavely so that the auxiliary pivot part 440 of the auxiliary washing unit 420 can pivot is disposed in a side portion of the main body 10.

Through the configuration of the present embodiment, the door 110 and the auxiliary washing unit 420 pivot in different directions so that the door 110 can be opened and closed even when the auxiliary washing unit 420 is pivoted to open the opening 24. That is, the auxiliary washing unit 420 and the door 110 may be provided to pivot independently.

While embodiments have been shown and described with reference to certain exemplary embodiments thereof, it will be understood by those skilled in the art that various changes in form and details may be made therein without departing from the spirit and scope of the invention as defined by the appended claims.

What is claimed is:

1. A washing machine comprising:

a main body having a first washing space and an opening through which to receive laundry into the first washing space; and an auxiliary washing unit seatable on the main body at a seating position while being coupled to the washing machine, the auxiliary washing unit including a bottom part having no opening formed therein, and a side part inclined from the bottom part, so that the bottom part and the side part form a second washing space which faces upward and is accessible through the opening in the main body when the auxiliary washing unit is seated on the main body at the seating position while being coupled to the washing machine, wherein the auxiliary washing unit includes a drain formed as a recession in an upper end of the side part so that the drain thereby forms an upper edge of the auxiliary washing unit, the drain thereby being operable to discharge water contained in the second washing space into the first washing space by moving the auxiliary washing unit from the seating position while being coupled to the washing machine.

2. The washing machine according to claim 1, wherein the auxiliary washing unit further includes a rubbing protrusion provided at the side part.

3. The washing machine according to claim 2, wherein the side part having the rubbing protrusion is formed to be inclined with respect to a bottom of the second washing space.

4. The washing machine according to claim 2, wherein the side part comprises a first surface and at least one second surface connected to the first surface, and the rubbing protrusion is provided at a portion at which the first surface and the second surface meet.

5. The washing machine according to claim 1, wherein the main body includes a seating part protruding toward the opening, and the auxiliary washing unit seats on the seating part to thereby be seated on the main body.

6. The washing machine according to claim 1, wherein a seating flange is provided at an upper end of the side part, and the main body has a seating part formed so that the seating flange seats on the seating part to thereby seat the auxiliary washing unit on the main body, wherein the seating flange does not protrude toward a side surface of the main body when the seating flange is seated on the seating flange.

7. The washing machine according to claim 1, further comprising:

a water tub disposed in the main body, wherein the auxiliary washing unit is disposed at a higher position than the water tub when the auxiliary washing unit is seated on the main body.

8. A washing machine comprising:

a main body having a first washing space; and an auxiliary washing unit pivotably coupleable to the washing machine so that, while the auxiliary washing unit is pivotably coupled to the washing machine, the auxiliary washing unit is pivotable with respect to the main body and is thereby seatable on the main body, the auxiliary washing unit forming a second washing space configured so that, while the auxiliary washing unit is pivotably coupled to the washing machine and is seated on the main body, the second washing space faces upward and is thereby configured to hold water and be accessible from above, wherein the auxiliary washing unit includes a drain configured to, while the auxiliary washing unit is pivotably coupled to the washing machine and the auxiliary washing unit is pivoted, discharge water held in the second washing space into the first washing space.

9. The washing machine according to claim 8, wherein the drain is adjacent to a pivot axis of the auxiliary washing unit.

10. The washing machine according to claim 9, wherein the auxiliary washing unit further includes a unit body that forms the second washing space, and first and second pivot parts connected to the unit body such that the unit body is pivotable about the pivot axis, and the drain is disposed between the first and second pivot parts.

11. The washing machine according to claim 8, wherein the auxiliary washing unit includes a side part to form the second washing space, and the drain is formed as a recession in a portion of an upper end of the side part.

12. The washing machine according to claim 8, wherein, while the auxiliary washing unit is pivotably coupled to the washing machine, the auxiliary washing unit is pivotable between a first position in which the auxiliary washing unit is seated on the main body and a second position in which the auxiliary washing unit is inclined with respect to the main body.

13. The washing machine according to claim 8, wherein the auxiliary washing unit further includes a pivot part coupleable to the main body, and the main body includes an insertion part into which the pivot part is insertable, to thereby allow the auxiliary washing unit to be pivotably coupleable to the washing machine.

14. The washing machine according to claim 8, wherein, while the auxiliary washing unit is pivotably coupled to the washing machine, the auxiliary washing unit is pivotable around a pivot axis at a first side of the auxiliary washing unit, and the auxiliary washing unit further includes a handle part at a second side of the auxiliary washing unit opposite to the first side.

15. The washing machine according to claim 14, wherein the handle part protrudes from a portion of an upper end of the second side and is thereby integrally formed with the second side.

16. A washing machine comprising:

a main body having a washing space and an opening provided at an upper portion of the washing space;

a door disposed to open and close the opening according to pivotal movement of the door with respect to the main body; and an auxiliary washing unit including a unit body, and an auxiliary pivot part protruding from the unit body and pivotably coupling the auxiliary washing unit to the door so that the auxiliary washing unit pivots around a pivot axis that is spaced apart from the unit body and that does not pass through the unit body.

17. The washing machine according to claim 16, wherein the pivot axis of the auxiliary washing unit and a pivot axis of the door coincide with each other.

18. The washing machine according to claim 16, wherein the door includes an insertion part hinged to the auxiliary pivot part.

19. The washing machine according to claim 16, wherein the pivot axis of the auxiliary washing unit is at a first side of the auxiliary washing unit, and the auxiliary washing unit includes an auxiliary handle part disposed at a second side of the auxiliary washing unit opposite to the first side, and the door includes a door handle part disposed in parallel with the auxiliary handle part.

20. An auxiliary washing unit comprising:

a unit body having a side part extending from a bottom thereof to form a washing space;

a pivot part protruding from the unit body and configured to pivotably mount the unit body on a washing machine so as to be rotatable about a pivot axis that is spaced apart from the unit body and that does not pass through the unit body; and a rubbing element disposed at the side part of the unit body, wherein the washing space is configured to, when the unit body is mounted on the washing machine and pivoted about the pivot axis to be seated on the washing machine, contain water and hold laundry to be hand washed with the contained water, and the auxiliary washing unit further comprises a drain provided at the unit body and formed as a recession in a portion of an upper end of the side part to discharge water contained in the washing space.

21. The auxiliary washing unit according to claim 20, wherein the side part is inclined with respect to the bottom.

22. The auxiliary washing unit according to claim 20, further comprising an opening/closing member configured to open and close the drain.

23. The auxiliary washing unit according to claim 20, further comprising a washing water inlet formed at the side part of the unit body such that water is supplied into the washing space.

24. The auxiliary washing unit according to claim 23, wherein the washing water inlet is formed as a recession in a portion of an upper end of the side part.

25. The auxiliary washing unit according to claim 20, wherein the pivot part protrudes from a first side of the unit body, and the auxiliary washing unit further comprises a handle part disposed at a second side of the unit body opposite to the first side.

26. The auxiliary washing unit according to claim 20, wherein the rubbing element includes rubbing protrusions arranged on the side part.

27. An auxiliary washing unit comprising:

a unit body having a bottom part and a side part extending from the bottom to form a washing space, and a washing water inlet formed at the side part such that water is supplyable into the washing space through the washing water inlet;

a pivot part protruding from the unit body and configured to pivotably mount the unit body on a washing machine so as to be rotatable about a pivot axis that is spaced apart from the unit body and that does not pass through the unit body; and a rubbing element disposed at the side part of the unit body, wherein the washing space is configured to, when the unit body is mounted on the washing machine and pivoted about the pivot axis to be seated on the washing machine, contain water supplied into the washing space through the washing water inlet and hold laundry to be hand washed with the contained water.

28. The auxiliary washing unit according to claim 27, wherein the washing water inlet is formed as a recession in a portion of an upper end of the side part.

* * * * *